US009192194B2

(12) United States Patent
Fakhouri et al.

(10) Patent No.: US 9,192,194 B2
(45) Date of Patent: Nov. 24, 2015

(54) MODULAR STORAGE RECEPTACLE FOR SMOKING MATERIAL, SYSTEM FOR STORING SMOKING MATERIAL, AND METHOD FOR USING SAME

(76) Inventors: Yazin Fakhouri, Chicago, IL (US); Robert J. Guyser, Chicago, IL (US)

( * ) Notice: Subject to any disclaimer, the term of this patent is extended or adjusted under 35 U.S.C. 154(b) by 948 days.

(21) Appl. No.: 13/136,250

(22) Filed: Jul. 27, 2011

(65) Prior Publication Data

US 2013/0025608 A1 Jan. 31, 2013

(51) Int. Cl.
*A24F 47/00* (2006.01)
*A24F 9/00* (2006.01)
*A24F 9/16* (2006.01)

(52) U.S. Cl.
CPC .... *A24F 9/00* (2013.01); *A24F 9/16* (2013.01)

(58) Field of Classification Search
CPC ..... A24F 6/16; A24F 9/00; A24F 15/00; A24F 15/18; A24F 15/12; B65D 85/10; B65D 85/1081; B65D 85/109
USPC ..... 206/244, 242, 256, 265, 236; 131/311, 131/329, 178
See application file for complete search history.

(56) References Cited

U.S. PATENT DOCUMENTS

| | | | | | |
|---|---|---|---|---|---|
| 1,444,308 | A * | 2/1923 | Dunning | 206/96 |
| 1,470,154 | A * | 10/1923 | Draughon | 206/102 |
| 1,683,851 | A * | 9/1928 | Wells | 206/236 |
| 2,006,773 | A * | 7/1935 | Moore et al. | 224/235 |
| 3,144,152 | A * | 8/1964 | Kopp | 215/6 |
| 3,451,533 | A * | 6/1969 | Butler | 206/246 |
| 4,214,658 | A * | 7/1980 | Crow | 206/244 |
| 5,465,738 | A * | 11/1995 | Rowland | 131/329 |
| 5,580,239 | A * | 12/1996 | Jang | 431/253 |
| 5,605,226 | A * | 2/1997 | Hernlein | 206/86 |
| 5,673,709 | A * | 10/1997 | Brothers | 131/231 |
| 5,794,771 | A * | 8/1998 | Krawec et al. | 206/223 |
| 5,848,596 | A * | 12/1998 | Zelenik | 131/329 |
| 5,967,310 | A * | 10/1999 | Hill | 206/242 |
| 6,290,059 | B1 * | 9/2001 | Chuan | 206/238 |
| 6,814,081 | B2 * | 11/2004 | Hasler | 131/235.1 |
| D702,398 | S * | 4/2014 | Fakhouri et al. | D27/181 |
| 2003/0029744 | A1 * | 2/2003 | Holler | 206/256 |
| 2005/0247582 | A1 * | 11/2005 | Rennecamp | 206/236 |
| 2008/0314778 | A1 * | 12/2008 | Hatton | 206/256 |
| 2011/0068026 | A1 * | 3/2011 | Fakhouri et al. | 206/244 |
| 2011/0192737 | A1 * | 8/2011 | Ancona et al. | 206/256 |
| 2013/0341218 | A1 * | 12/2013 | Liu | 206/242 |

* cited by examiner

*Primary Examiner* — Steven A. Reynolds
(74) *Attorney, Agent, or Firm* — Scherrer Patent & Trademark Law, P.C.; Stephen T. Scherrer; Monique A. Morneault

(57) ABSTRACT

A storage receptacle for smoking material may open on two opposite sides. A first end of the storage receptacle may have teeth which extend from the first end of the storage receptacle. A second end of the storage receptacle may have one or more cavities which store a pipe, a lighter and/or a cleaning pick. A first cover and a second cover may be removed from the first end and the second end of the receptacle, respectively. The first cover may have teeth, and the first cover may be rotated relative to the first end of the receptacle to grind, to divide and/or to separate the smoking material into smaller sizes using the teeth. Threads may connect the first cover to the first end and the second cover to the second end. A sieve cylinder may have a screen which collects the smoking material having smaller sizes.

13 Claims, 21 Drawing Sheets

MODULAR STORAGE RECEPTACLE FOR SMOKING MATERIAL, SYSTEM FOR STORING SMOKING MATERIAL, AND METHOD FOR USING SAME

BACKGROUND OF THE INVENTION

The present invention generally relates to a storage receptacle for smoking material, such as, for example, tobacco or the like, a system for storing smoking material, and a method for using the same.

Storage receptacles which have a cavity for a pipe and an additional cavity for smoking material are commonly known. Smoking a pipe may require certain tools, such as the pipe, and the storage receptacle may store one or more of the tools. Traditionally, the storage receptacle is a pocket-sized rectangular box, and the storage receptacle has a rectangular cavity for storing the smoking material and a cylindrical cavity for storing the pipe. Typically, one side of the storage receptacle has a cover that slides or twists open to reveal the two cavities.

A disadvantage of known storage receptacles is that the storage receptacle does not store all necessary tools for smoking the pipe. The storage receptacle stores the smoking material and the pipe; however, a user must then obtain matches or a lighter, for example. Thus, the user may not be able to smoke the pipe and the smoking material provided by the storage receptacle without the matches or the lighter.

To reduce the size and the weight of the storage receptacle, the pipe stored by the smoking receptacle has a small size. Use of the pipe requires insertion of the pipe into the cavity of the storage receptacle that stores the smoking material to pack the smoking material into the small pipe. For the smoking material to fit into the pipe, the smoking material must have a small size because the pipe has a small size. However, the smoking material is typically larger in size and is generally sold fresh and uncut. If the smoking material is bulky or leafy, the smoking material may not fit into the pipe. Thus, another disadvantage of known storage receptacles is that the storage receptacle does not provide a way to break and/or to divide the smoking material into smaller sizes.

Yet another disadvantage of known storage receptacles for smoking material is difficulty that is encountered to clean the pipe after use of the pipe. The smoking material burned during use of the pipe accumulates in the pipe and must be removed before the pipe receives fresh smoking material. A user may strike the pipe against a hard surface to remove the charred material. However, hitting the pipe on the hard surface may damage the pipe.

An additional disadvantage of known storage receptacles for smoking materials is that the user cannot customize the storage receptacle.

Therefore, a storage receptacle for smoking material having a storage cavity for a lighter, matches or other flame generating device is desirable. Further, a storage receptacle for smoking material having a way to grind, to divide and/or to separate the smoking material into a smaller size that may fit into the pipe is desirable. Still further, a storage receptacle for smoking material that stores a cleaning tool to remove charred material from the pipe is desirable. Moreover, a modular storage receptacle for smoking material is desirable.

SUMMARY OF THE PRESENT INVENTION

The present invention generally relates to a storage receptacle for smoking material, such as, for example, tobacco or the like, a system for storing smoking material, and a method for using the same. More specifically, the present invention relates to a storage receptacle that may open on two opposite ends. The storage receptacle may store the smoking material, a pipe, a lighter and/or a cleaning pick. The storage receptacle may have components which form a grinder. A first cover and a second cover may be reversibly removed from the first end and the second end of the receptacle, respectively.

It is, therefore, an advantage of the present invention to provide a storage receptacle for smoking material and a method for using the same.

Further, an advantage of the present invention is to provide a storage receptacle for smoking material that may store a lighter.

Another advantage of the present invention is to provide a storage receptacle for smoking material that may store a cleaning pick for cleaning the pipe after use.

Yet another advantage of the present invention is to provide a storage receptacle for smoking material that may be lighter and/or more compact relative to prior art receptacles.

Still further, an advantage of the present invention is to provide a storage receptacle for smoking material that may open on opposite sides to store smoking equipment.

Yet another advantage of the present invention is to provide a storage receptacle for smoking material that may have components for grinding, dividing and/or to separating the smoking material into smaller sizes.

Still another advantage of the present invention is to provide a storage receptacle for smoking material that may have a kief screen and a cap which may function as a kief catcher.

Yet another advantage of the present invention is to provide a storage receptacle for smoking material that may have a first cover and a second cover that may rotate relative to the storage receptacle to provide access to one or more cavities in the storage receptacle and may rotate in an opposite direction to prevent access to one or more cavities in the storage receptacle.

Further, an advantage of the present invention is to provide a storage receptacle for smoking material that may have threads which connect the first cover to the first end and connect the second cover to the second end.

Another advantage of the present invention is to provide a storage receptacle for smoking material that may be customized to be used with or without an extension cylinder.

Yet another advantage of the present invention is to provide a storage receptacle for smoking material that may prevent and/or may hinder odor from exiting the storage receptacle and/or may prevent water and/or other liquids from entering the storage receptacle.

Moreover, another advantage of the present invention is to provide a storage receptacle for smoking material that may have a grinder.

BRIEF DESCRIPTION OF THE DRAWINGS

FIGS. 19 and 23 illustrate side plan views of a receptacle in embodiments of the present invention.

DETAILED DESCRIPTION OF THE PREFERRED EMBODIMENTS

The present invention generally relates to a storage receptacle for smoking material, such as, for example, tobacco or the like, a system for storing smoking material, and a method for using the same. More specifically, the present invention relates to a storage receptacle that may open on two opposite ends. A first end of the storage receptacle may have teeth which extend from the first end of the storage receptacle. A second end of the storage receptacle may have one or more cavities which store a pipe, a lighter and/or a cleaning pick. A first cover and a second cover may be removed from the first end and the second end of the receptacle, respectively. The first cover may have teeth, and the first cover may be rotated relative to the first end of the receptacle to grind, to divide and/or to separate the smoking material into smaller sizes using the teeth. Threads may connect the first cover to the first end and the second cover to the second end. A sieve cylinder may have a screen which collects the smoking material having smaller sizes.

Figure 1:
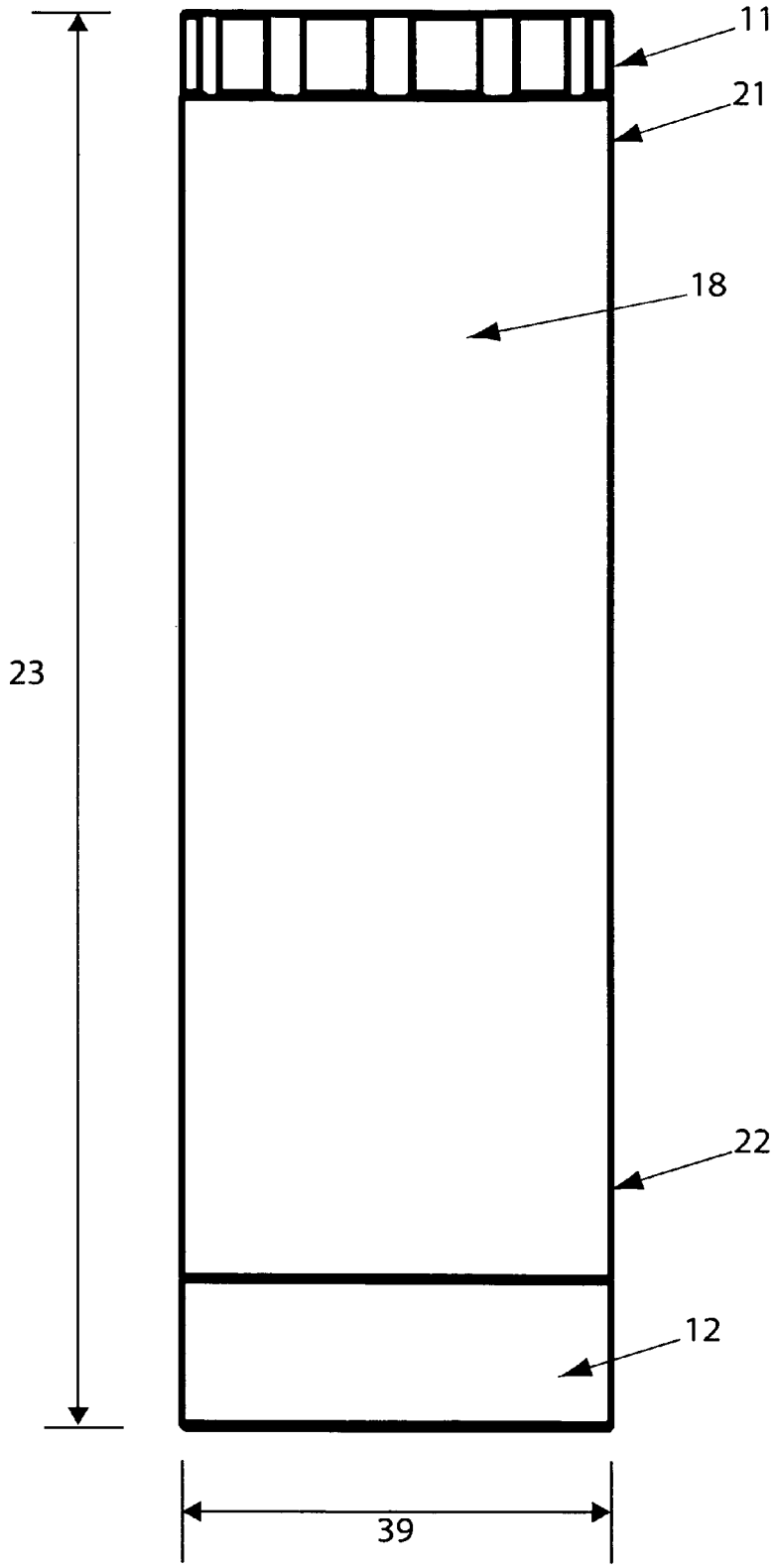
FIG. 1 illustrates a side plan view of a receptacle in an embodiment of the present invention.
Figure 2:
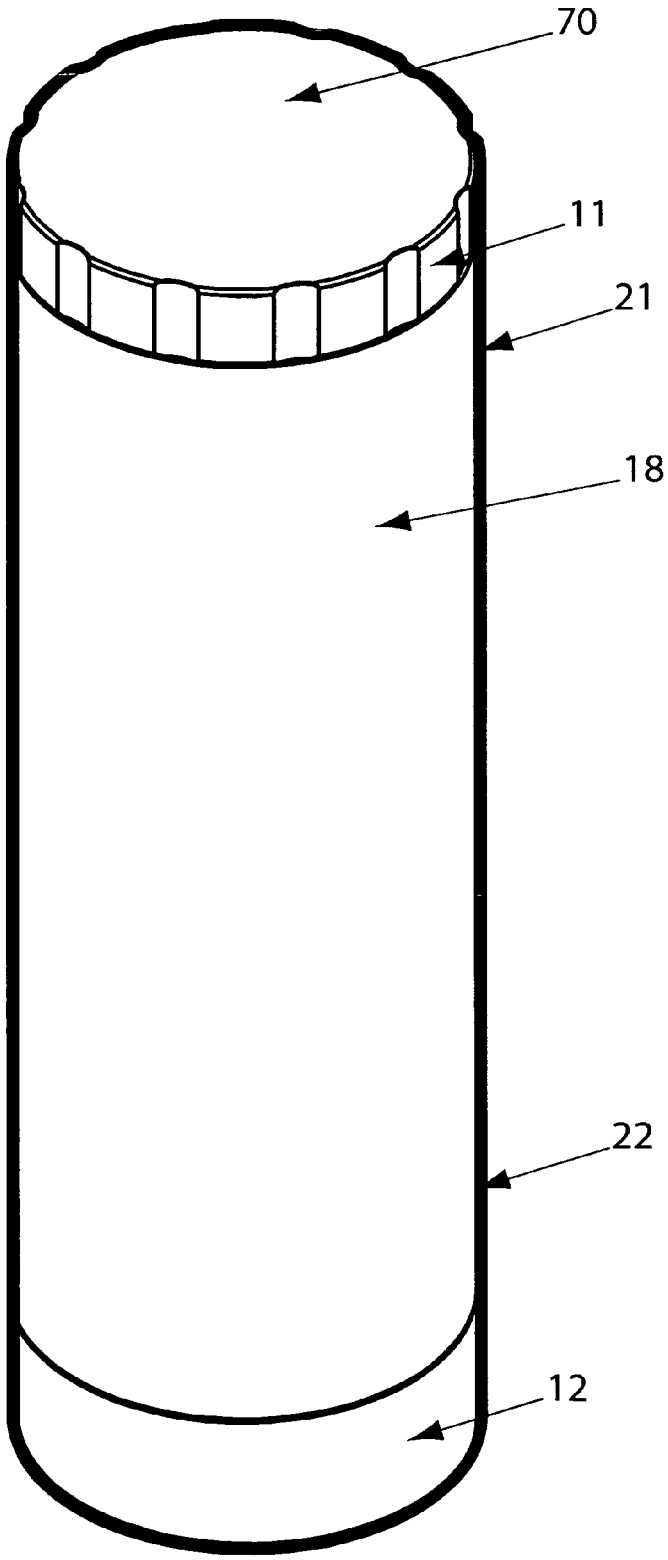
FIGS. 2, 3, 5 and 6 illustrate perspective views of a receptacle in embodiments of the present invention.
Figure 3:
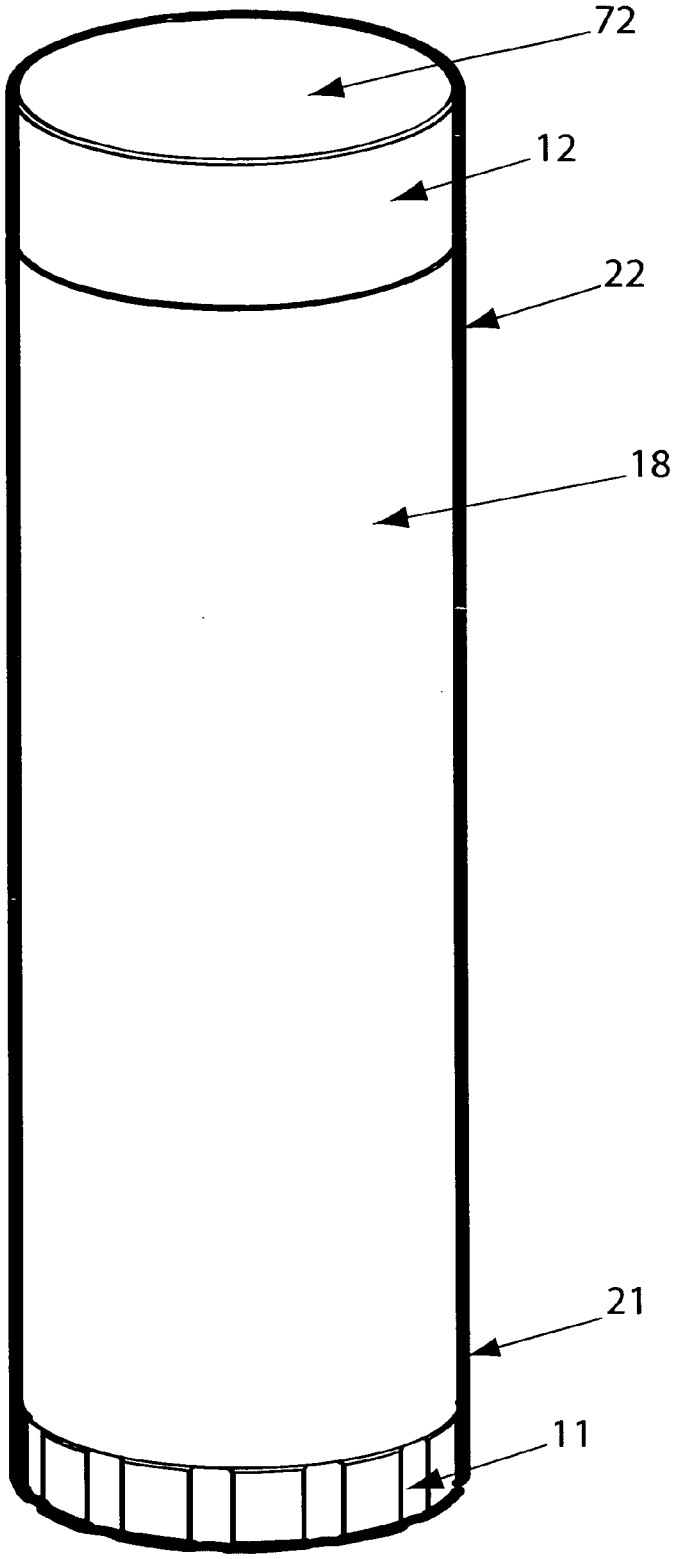
Figure 4A:
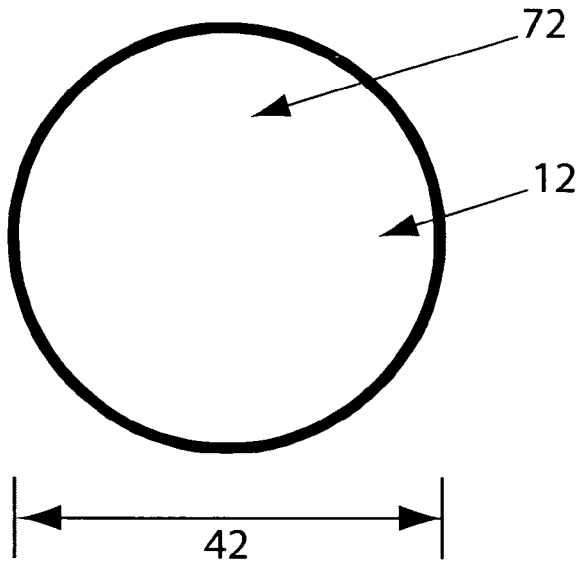
FIG. 4A illustrates a top plan view of a receptacle with the second cover connected to the receptacle in an embodiment of the present invention.
Figure 4B:
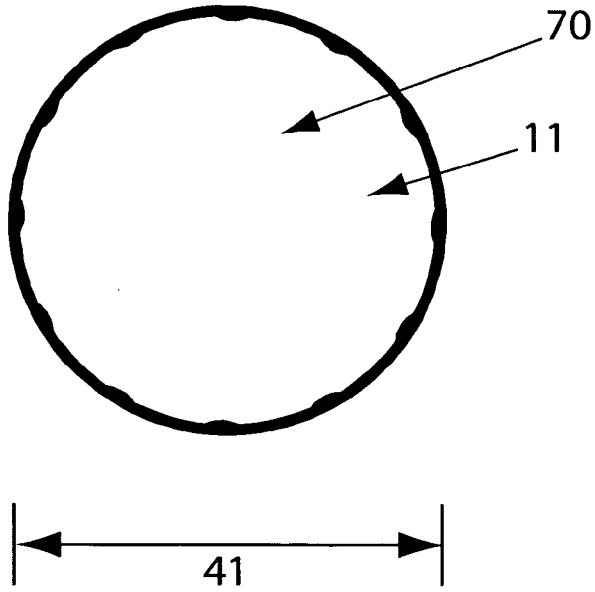
FIG. 4B illustrates a bottom plan view of a receptacle with the first cover connected to the receptacle from an opposite view relative to FIG. 4A in an embodiment of the present invention.
Figure 4C:
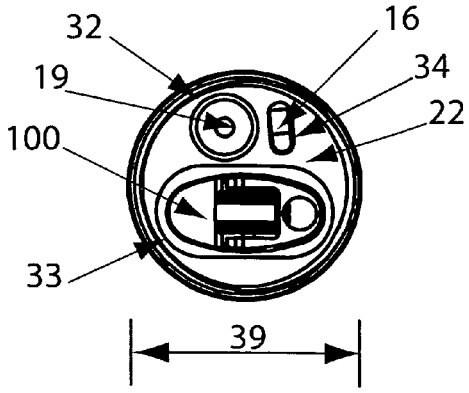
FIG. 4C illustrates a top plan view of a receptacle with the second cover removed from the receptacle and smoking equipment stored by the receptacle in an embodiment of the present invention.
Figure 4D:
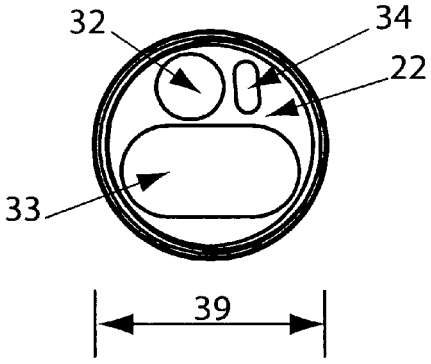
FIG. 4D illustrates a top plan view of a receptacle with the second cover removed from the receptacle without the smoking equipment stored by the receptacle in an embodiment of the present invention.
Figure 4E:
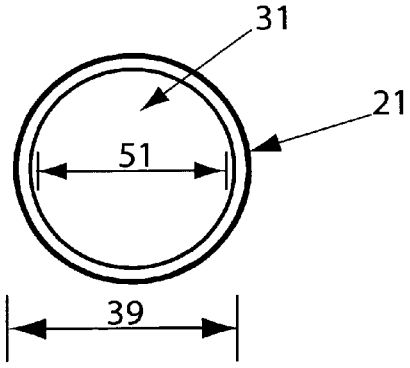
FIG. 4E illustrates a bottom plan view of a receptacle with the first cover removed from the receptacle in an embodiment of the present invention.

Referring now to the drawings wherein like numerals refer to like parts, FIG. 1 illustrates a side plan view of a receptacle 18, and FIGS. 2 and 3 illustrate perspective views of the receptacle 18. In an embodiment, the receptacle 18 may be cylindrical. The receptacle 18 may have a first end 21 and/or a second end 22 that may define a height 23 of the receptacle 18. As generally illustrated in FIGS. 4D and 4E, the first end 21 and/or the second end 22 may have a circular shape. The present invention is not limited to a specific shape of the receptacle 18, the first end 21 or the second end 22, and the receptacle 18, the first end 21 or the second end 22 may be any shape.

Referring to FIGS. 1-3, a first cover 11 and/or a second cover 12 may connect to the receptacle 18 as described in more detail hereafter. The first cover 11 and/or the second cover 12 may have a cylindrical shape. The first cover 11 may have an outer face 70 and/or an inner face 71. The inner face 71 may be located in a position opposite to the outer face 70. The second cover 12 may have an outer face 72 and/or an inner face 73. The inner face 73 may be located in a position opposite to the outer face 72. As shown in FIGS. 2, 3, 4A and 4E, the outer face 70 of the first cover 11 and/or the outer face 72 of the second cover 12 may have a circular shape substantially similar to the circular shape of the first end 21 and/or the second end 22 of the receptacle 18. The present invention is not limited to a specific shape of the outer face 70 of the first cover 11 or the outer face 72 of the second cover 12.

Figure 9:
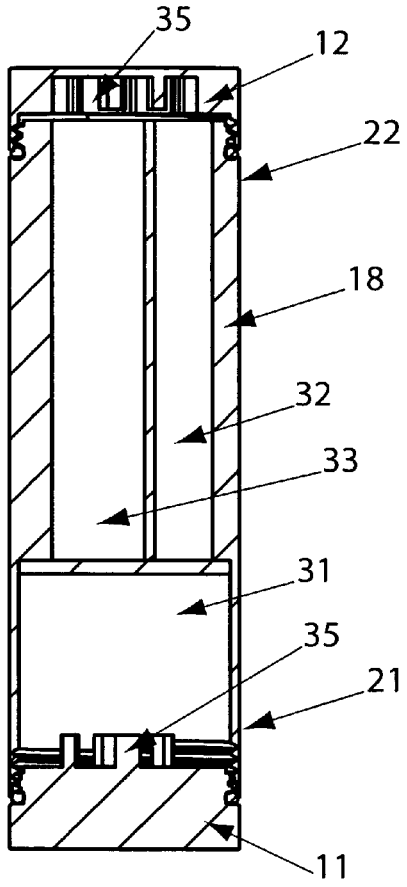
FIG. 9 illustrates a cross-sectional view of a receptacle in an embodiment of the present invention.
Figure 5:
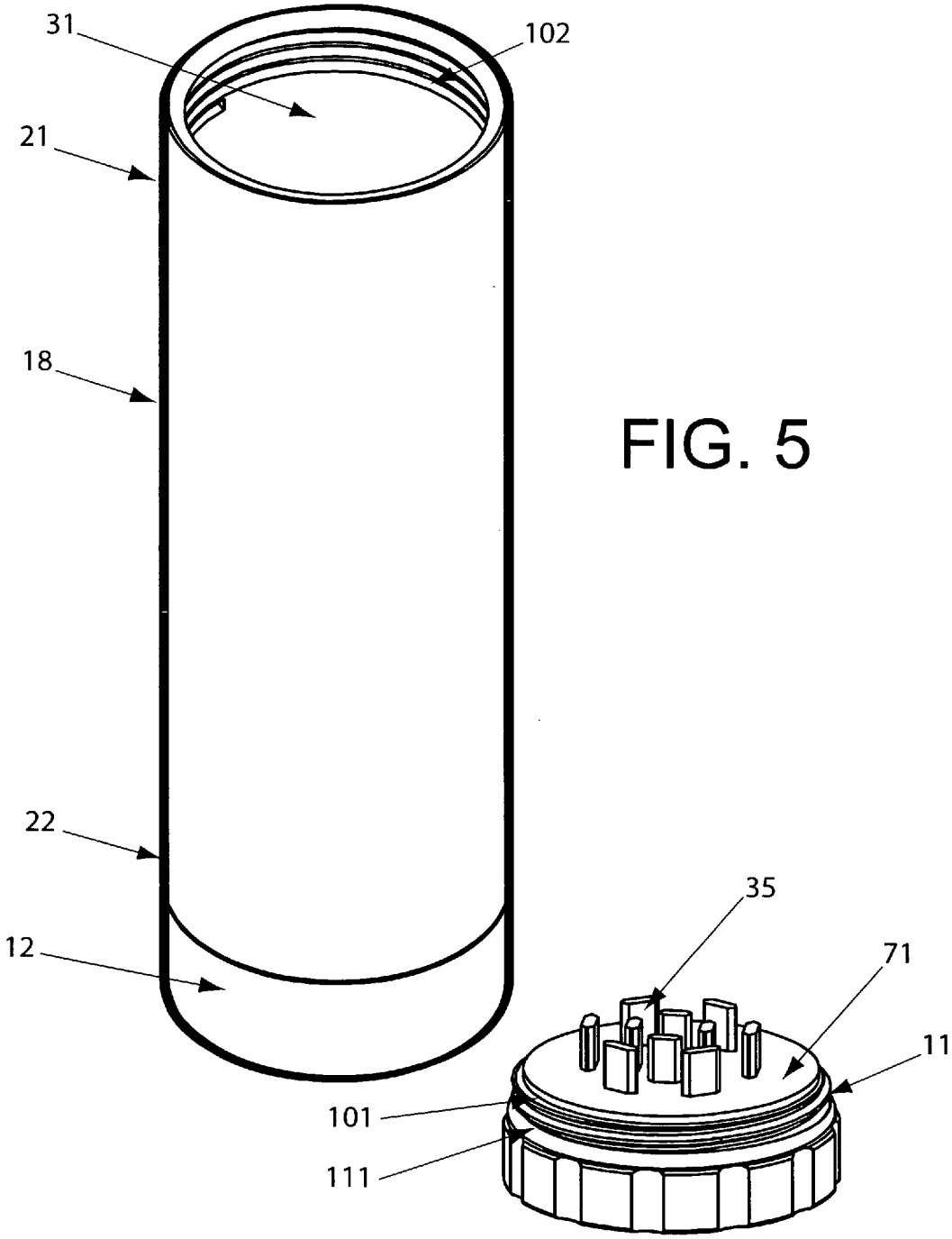
Figure 6:
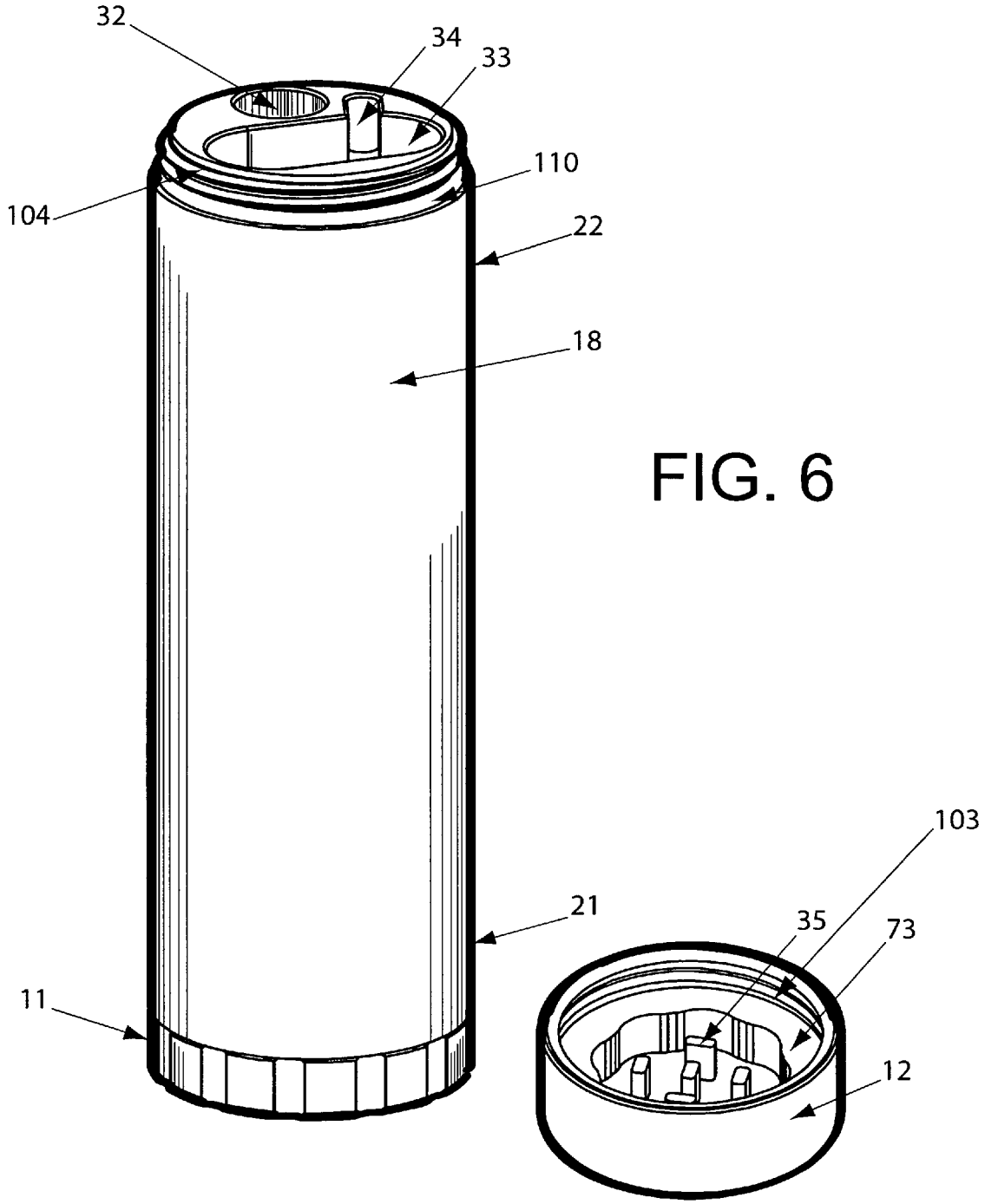

As shown in FIGS. 5, 6 and 9, the inner face 71 of the first cover 11 and/or the inner face 73 of the second cover 12 may have teeth 35. The teeth 35 may be, for example, indentations, extensions, protrusions, ridges and/or the like. In an embodiment, the teeth 35 may be rectangular protrusions. However, the teeth 35 may be any shape, and the present invention is not limited to a specific embodiment of the teeth 35.

Figure 8:
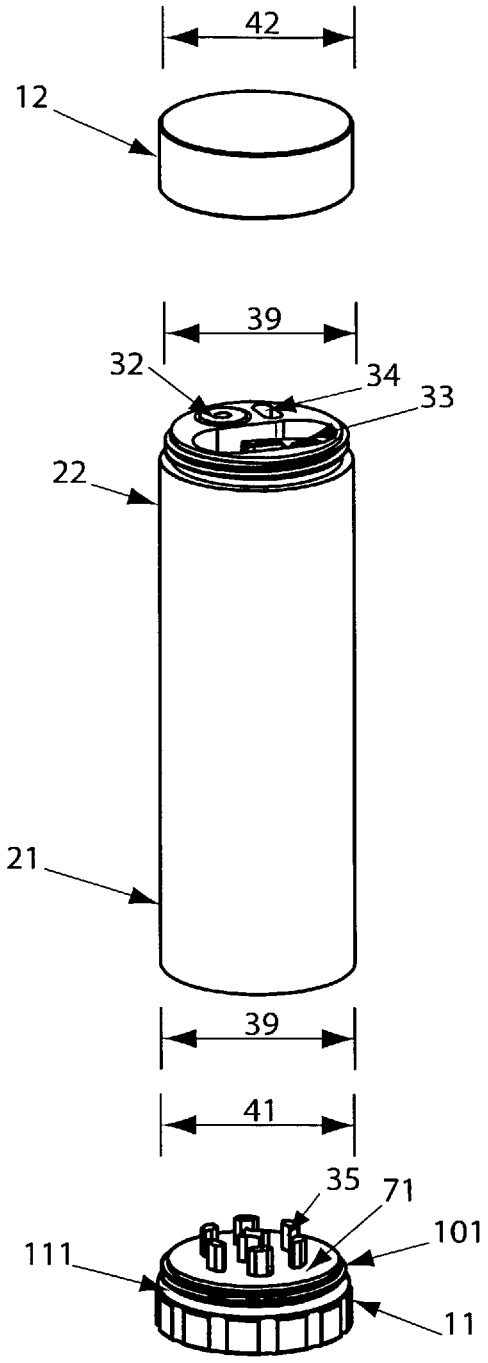

Referring again to FIG. 1, the receptacle 18 may have a diameter 39. In an embodiment, the diameter 39 of the receptacle 18 may be uniform. More specifically, the diameter 39 of the receptacle 18 may be substantially the same from the first end 21 to the second end 22. As shown in FIG. 4B, the first cover 11 may have a diameter 41. As shown in FIG. 4A, the second cover 12 may have a diameter 42. As shown in FIG. 8, the diameter 39 of the receptacle 18, the diameter 41 of the first cover 11, and/or the diameter 42 of the second cover 12 may be approximately equal. In an embodiment, the diameter 39 of the receptacle 18, the diameter 41 of the first cover 11, and/or the diameter 42 of the second cover 12 may be approximately 1.25 inches. However, the present invention is not limited to a specific diameter of the diameter 39 of the receptacle 18, the diameter 41 of the first cover 11, or the diameter 42 of the second cover 12.

The receptacle 18, the first cover 11 and/or the second cover 12 may be made from any material. In an embodiment, the receptacle 18, the first cover 11 and/or the second cover 12 may be aluminum. In another embodiment, the receptacle 18, the first cover 11 and/or the second cover 12 may be plastic. In an embodiment, the receptacle 18, the first cover 11 and/or the second cover 12 may have an anodized finish. The receptacle 18, the first cover 11 and/or the second cover 12 may be made using any manufacturing method known to one having ordinary skill in the art. In an embodiment, the receptacle 18, the first cover 11 and/or the second cover 12 may be manufactured using an extrusion process.

Figure 7:
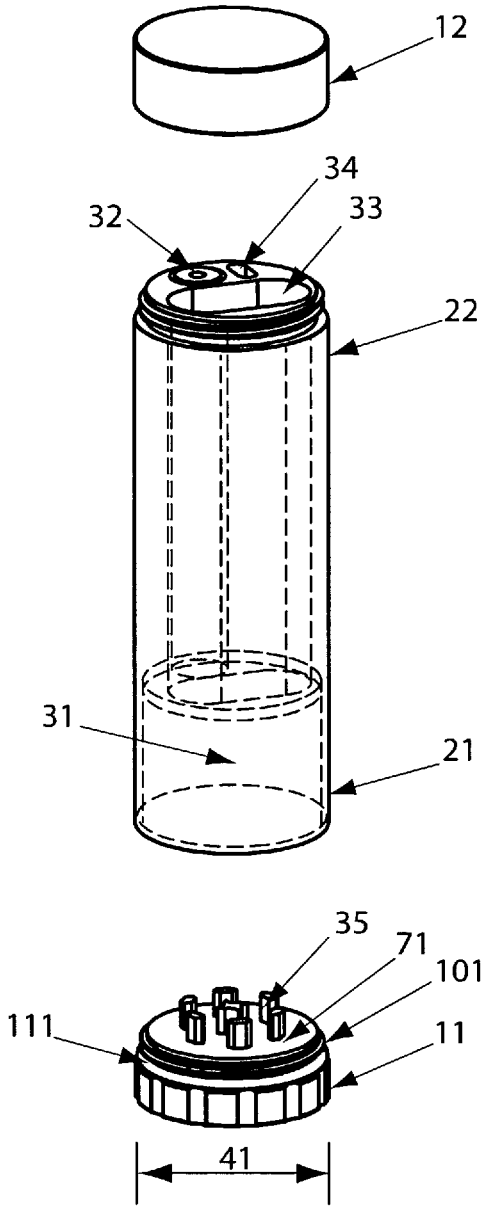
FIGS. 7, 8 and 10 illustrate perspective exploded views of a receptacle in embodiments of the present invention.

Referring to FIGS. 4E, 5, 7 and 9, the first end 21 of the receptacle 18 may have a first cavity 31. As shown in FIG. 4E, the first cavity 31 may have a diameter 51. In an embodiment, the diameter 51 of the first cavity 31 may be approximately equal to the diameter 39 of the receptacle 18. The first cavity 31 may be used to store smoking material, such as, for example, tobacco, herbs, herbal blends and/or the like. As shown in FIGS. 1-3 and 9, the first cover 11 may connect to the first end 21 of the receptacle 18 to limit and/or to prevent access to the first cavity 31. As shown in FIGS. 5, 7 and 8, the first cover 11 may disconnect from the first end 21 of the receptacle 18 to provide access to the first cavity 31.

For example, as shown in FIG. 5, the first cover 11 may have first threads 101, and/or the first end 21 may have second threads 102. The first threads 101 and/or the second threads 102 may be directly connected to the first cover 11 and/or the second end 22, respectively. For example, the first threads 101 and/or the second threads 102 may be integral with the first cover 11 and/or the first end 21, respectively.

The first threads 101 may disconnect from the second threads 102 to disconnect the first cover 11 from the first end 21 of the receptacle 18. Then, the first threads 101 may re-connect to the second threads 102 to re-connect the first cover 11 to the first end 21 of the receptacle 18. For example, rotation of the first cover 11 in a first direction relative to the first end 21 of the receptacle 18 may disconnect the first threads 101 from the second threads 102. As a result, the first cover 11 may disconnect from the first end 21 of the receptacle 18. The first cover 11 may be rotated relative to the first end 21 of the receptacle 18 in a second direction opposite to the first direction. Rotation of the first cover 11 in the second direction may re-connect the first threads 101 to the second threads 102. As a result, the first cover 11 may re-connect to the first end 21 of the receptacle 18.

The first threads 101 and/or the second threads 102 may be helical. The first threads 101 may be angled relative to the first cover 11 at approximately the same angle that the second threads 102 are angled relative to the first end 21 of the receptacle 18. In an embodiment, the first threads 101 may be male threads, and the second threads 102 may be female threads. For example, the first threads 101 may extend in a direction generally outward from the first cover 11, and/or the second threads 102 may extend in a direction generally inward into the first end 21 of the receptacle 18. The first threads 101 may insert into the second threads 102 to connect the first threads 101 to the second threads 102.

In another embodiment, the first threads 101 may be female threads, and the second threads 102 may be male threads. For example, the first threads 101 may extend in a direction generally inward into the first cover 11, and/or the second threads 102 may extend in a direction generally outward from the first end 21 of the receptacle 18. The second threads 102 may insert into the first threads 101 to connect the first threads 101 to the second threads 102.

Figure 10:
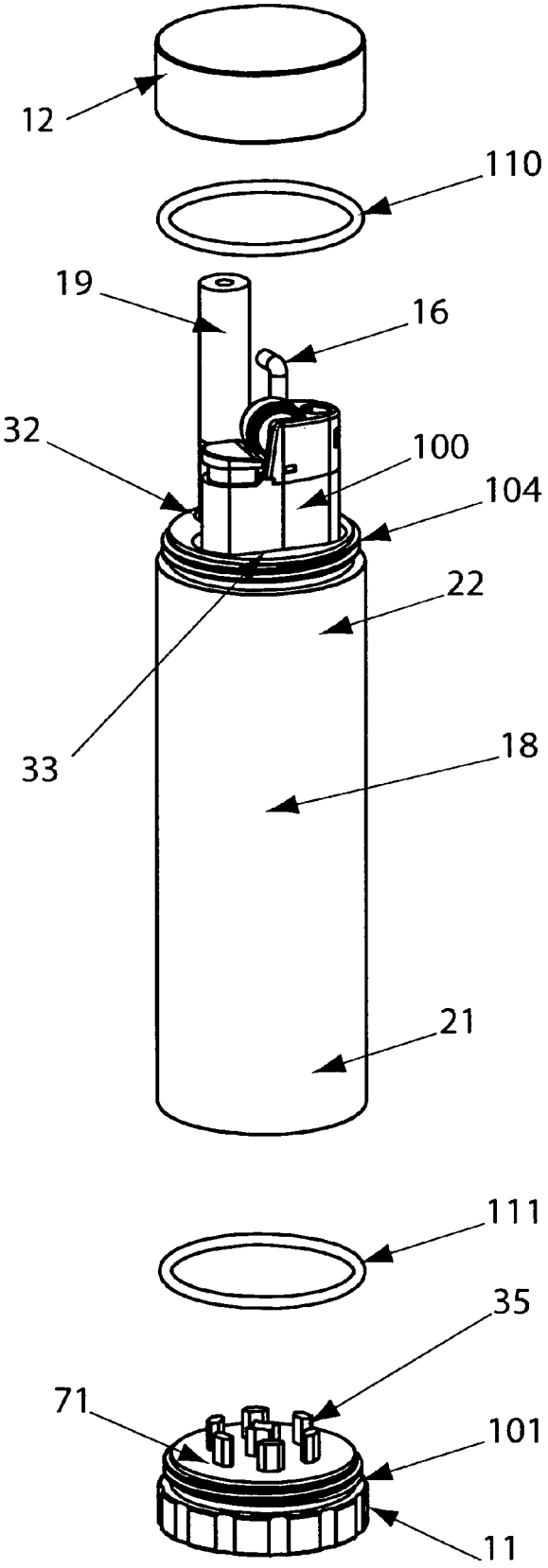
Figure 11:
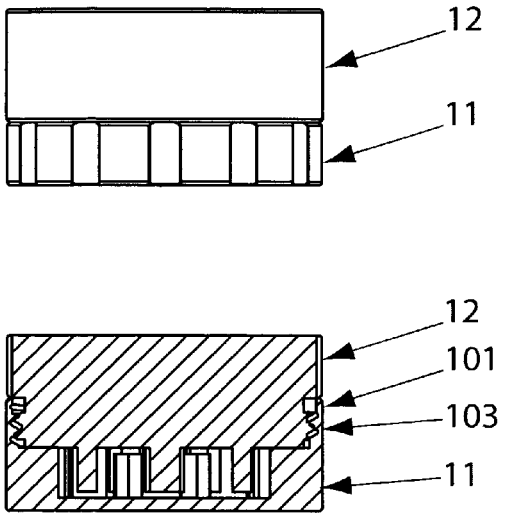
FIG. 11 illustrates a side plan view of the first cover connected to the second cover in an embodiment of the present invention.
Figure 12:
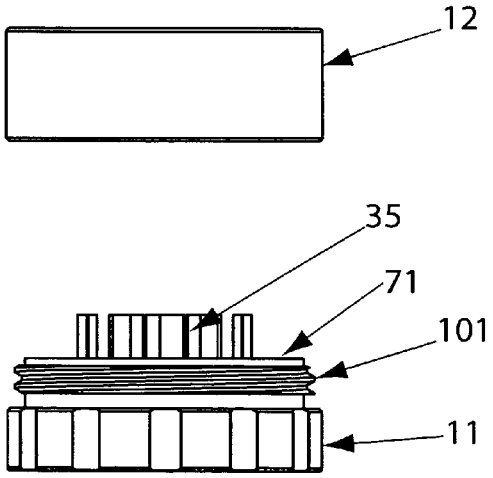
FIG. 12 illustrates a side plan view of the first cover and the second cover disconnected in an embodiment of the present invention.
Figure 13:
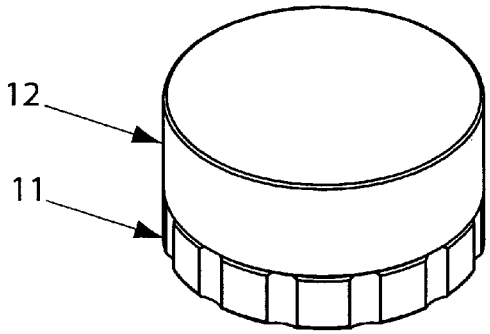
FIG. 13 illustrates a perspective view of the first cover connected to the second cover in an embodiment of the present invention.
Figure 14:
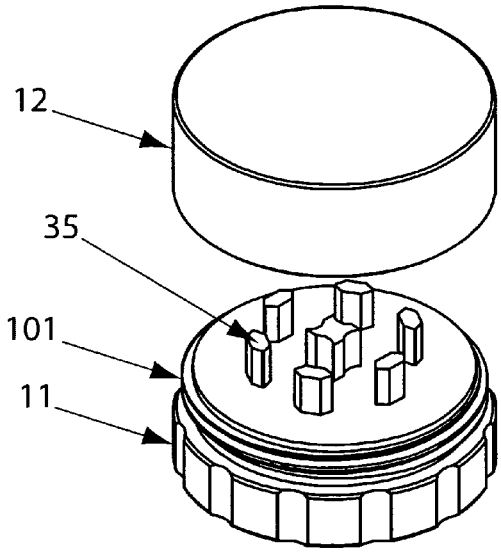
FIG. 14 illustrates a perspective view of the first cover and the second cover disconnected in an embodiment of the present invention.
Figure 15:
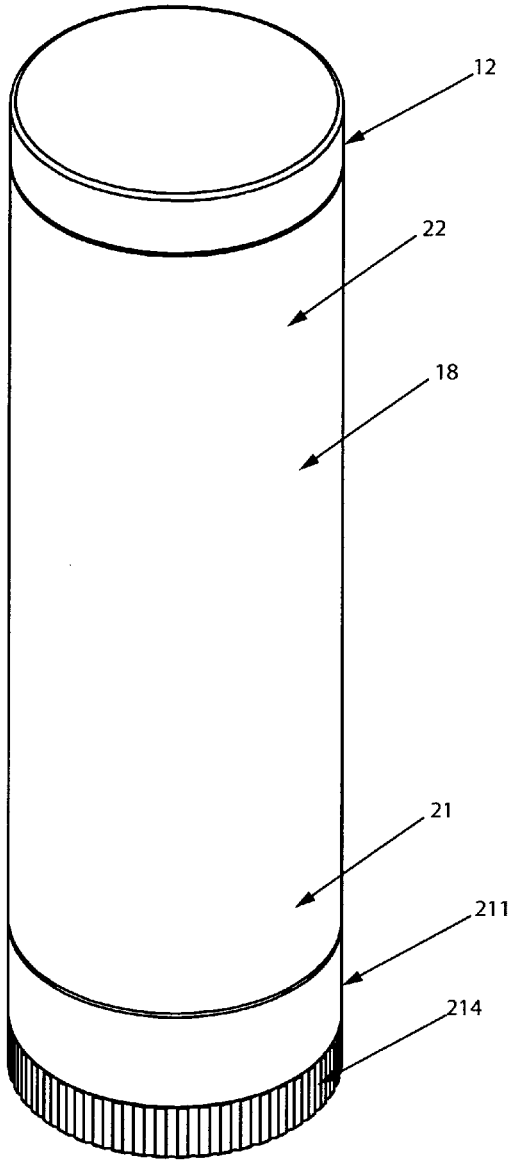
FIG. 15 illustrates a perspective view of a receptacle in an embodiment of the present invention.
Figure 16:
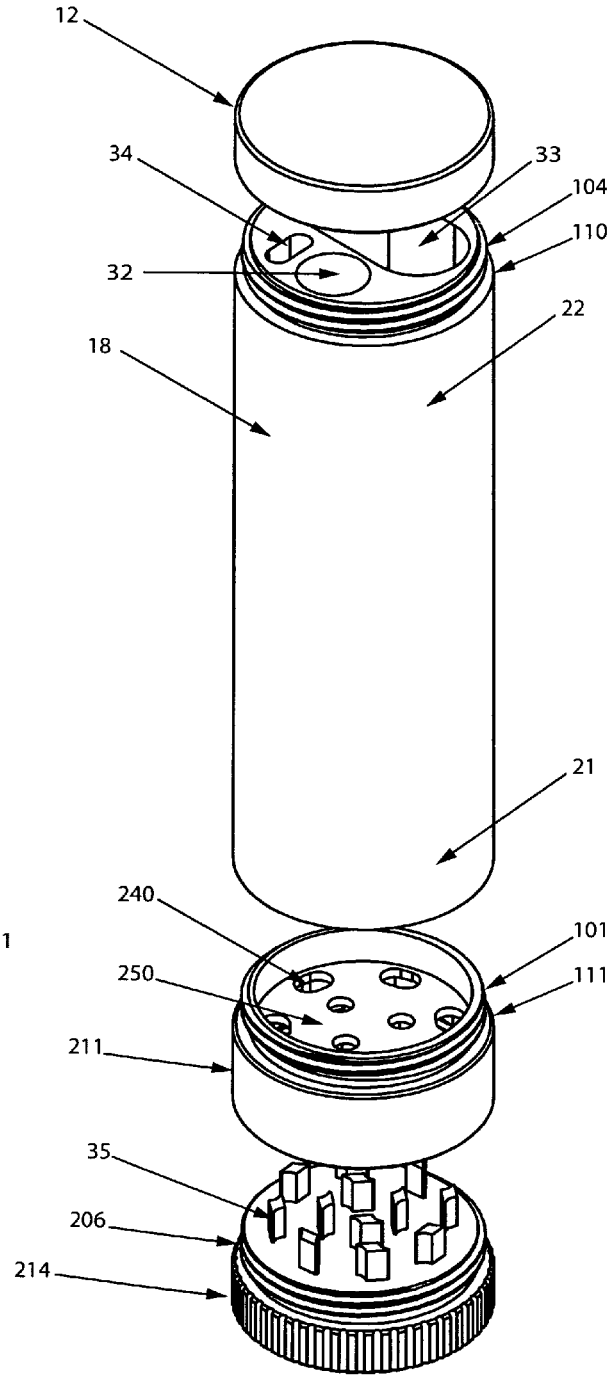
FIGS. 16, 19, 20, 24, 25, 26, 27 and 28 illustrate perspective exploded views of a receptacle in embodiments of the present invention.
Figure 17:
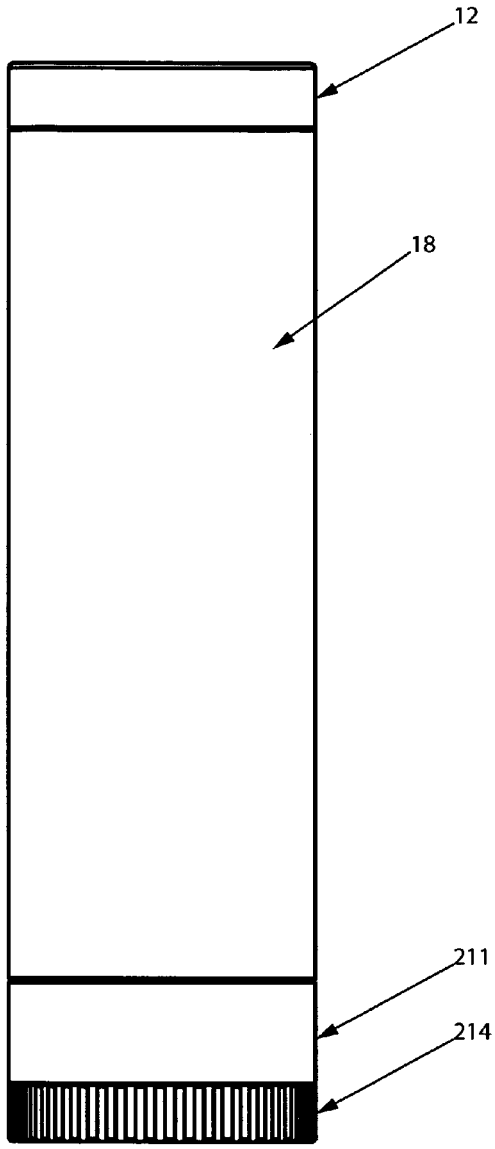
FIG. 17 illustrates a side plan view of a receptacle in an embodiment of the present invention.
Figure 18:
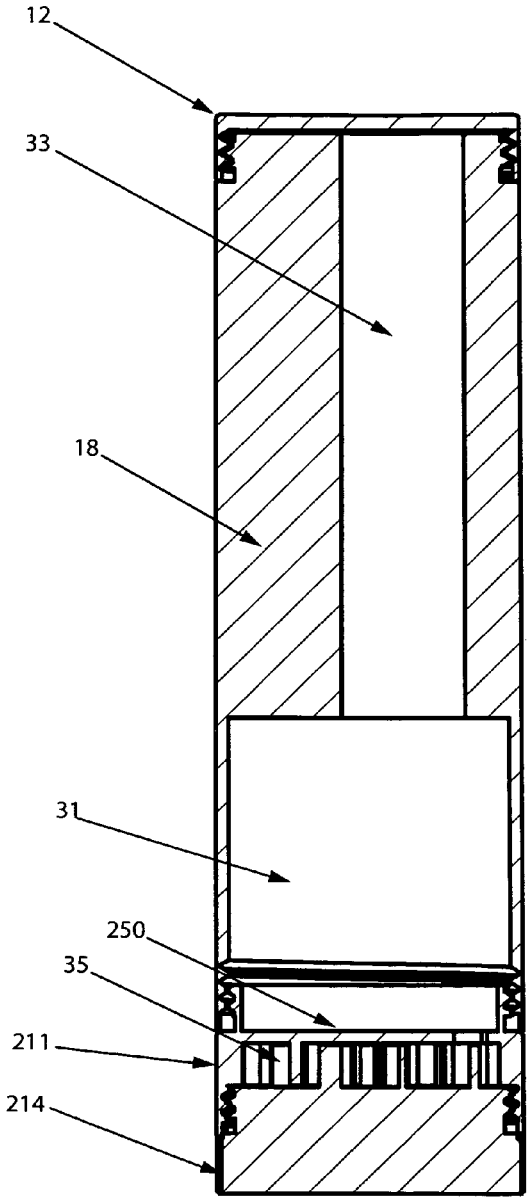
FIGS. 18 and 29 illustrate cross-sectional views of a receptacle in embodiments of the present invention.

As shown in FIGS. 5 and 10, the first cover 11 and/or the first end 21 of the receptacle 18 may have a first o-ring 111. The first o-ring 111 may be a loop which may have a disc-shaped cross-section. The first o-ring 111 may be made from any material. In an embodiment, the first o-ring 111 may be an elastomer, such as, for example, silicone. In an embodiment where the first o-ring 111 is connected to the first cover 11, the first o-ring 111 may be located adjacent to the first threads 101. In an embodiment where the first o-ring 111 is connected to the first end 21 of the receptacle 18, the first o-ring 111 may be located adjacent to the second threads 102.

The first o-ring 111 may be compressed if the first cover 11 is connected to the first end 21 of the receptacle 18. The first o-ring 111 may create a seal between the first cover 11 and the first end 21 of the receptacle 18. The first o-ring 111 may prevent and/or may hinder odor from exiting the receptacle 18 and/or the first cover 11. The first o-ring 111 may prevent water and/or other liquids from entering the receptacle 18 and/or the first cover 11.

As shown in FIGS. 4C, 4D and 6-9, the second end 22 of the receptacle 18 may have a second cavity 32 which may have a cylindrical shape and/or may store a pipe 19 having a cylindrical shape. In an embodiment, the second cavity 32 may have approximately the same dimensions, such as, for example, the same size and/or the same shape, as the pipe 19. The user may insert the pipe 19 into the first cavity 31 to push the smoking material located in the first cavity 31 into the pipe 19. The pipe 19 may be made from any material. In an embodiment, the pipe 19 may be aluminum. In another embodiment, the pipe 19 may be quartz glass.

The second end 22 of the receptacle 18 may have a third cavity 33 and/or a fourth cavity 34. The third cavity 33 may store a lighter 100 for emitting a flame to burn the smoking material located in the pipe 19. For example, the lighter 100 may contain fluid (not shown) that may be used to generate the flame. The present invention is not limited to a specific embodiment of the lighter 100, and the lighter 100 may be any device capable of generating the flame as known to one having ordinary skill in the art.

The lighter 100 may be reversibly removable from the receptacle 18. For example, the user may remove the second cover 12 to obtain access to the third cavity 33. Then, the user may remove the lighter 100 from the third cavity 33. After use of the lighter 100, the user may return the lighter 100 to the third cavity 33. Then, the user may re-connect the second cover 12 to the second end 22 of the receptacle 18 to hold the lighter 100 within the third cavity 33. Further, the lighter 100 may be replaced with a new lighter, such as, for example, if the fluid of the lighter 100 is insufficient for generating the flame.

The fourth cavity 34 may store a cleaning pick 16 for cleaning the pipe 19 after use of the pipe 19. For example, the cleaning pick 16 may have a cylindrical shape, and/or the cleaning pick 16 may be inserted into the pipe 19 to remove burned smoking material. As shown in FIGS. 7 and 9, the second cavity 32, the third cavity 33 and/or the fourth cavity 34 may extend from the second end 22 of the receptacle 18 to a position adjacent to the first cavity 31.

The fourth cavity 34 may have a cylindrical shape that may accommodate storage of the cleaning pick 16. In an embodiment, the cleaning pick 16 may have an "L" shape that may prevent the cleaning pick 16 from falling into the fourth cavity 34, may assist the user in removing the cleaning pick 16 from the fourth cavity 34, and/or may assist the user in cleaning the pipe 19 with the cleaning pick 16. The present invention is not limited to a specific embodiment of the cleaning pick 16.

As shown in FIGS. 1-3 and 9, the second cover 12 may connect to the second end 22 of the receptacle 18 to limit and/or to prevent access to the second cavity 32, the third cavity 33 and/or the fourth cavity 34. If the second cover 12 is connected to the receptacle 18, the second cover 12 may maintain a position of the pipe 19 in the second cavity, may maintain a position of the lighter 100 in the third cavity 33, and/or may maintain a position of the cleaning pick 16 in the fourth cavity 34. For example, if the second cover 12 is connected to the receptacle 18, the teeth 35 and/or the inner face 73 of the second cover 12 may contact the pipe 19, the lighter 100 and/or the cleaning pick 16 to prevent movement of the pipe 19, the lighter 100 and/or the cleaning pick 16 relative to the receptacle 18, respectively.

As shown in FIGS. 6-8, disconnecting the second cover 12 from the second end 22 of the receptacle 18 may provide access to the second cavity 32, the third cavity 33 and/or the fourth cavity 34. For example, as shown in FIG. 6, the second cover 12 may have third threads 103, and/or the second end 22 may have fourth threads 104. The third threads 103 and/or the fourth threads 104 may be directly connected to the second cover 12 and/or the second end 22, respectively. For example, the third threads 103 and/or the fourth threads 104 may be integral with the second cover 12 and/or the second end 22, respectively.

The third threads 103 may disconnect from the fourth threads 104 to disconnect the second cover 12 from the second end 22 of the receptacle 18. The third threads 103 may re-connect to the fourth threads 104 to re-connect the second cover 12 to the second end 22 of the receptacle 18. For example, rotation of the second cover 12 in a first direction relative to the second end 22 of the receptacle 18 may disconnect the third threads 103 from the fourth threads 104. As a result, the second cover 12 may disconnect from the second end 22 of the receptacle 18. The second cover 12 may be rotated relative to the second end 22 of the receptacle 18 in a second direction opposite to the first direction. Rotation of the second cover 12 in the second direction may re-connect the third threads 103 to the fourth threads 104. As a result, the second cover 12 may re-connect to the second end 22 of the receptacle 18.

The third threads 103 and/or the fourth threads 104 may be helical. The third threads 103 may be angled relative to the second cover 12 at approximately the same angle that the fourth threads 104 are angled relative to the second end 22 of the receptacle 18. In an embodiment, the third threads 103 may be male threads, and the fourth threads 104 may be female threads. For example, the third threads 103 may extend in a direction generally outward from the second cover 12, and/or the fourth threads 104 may extend in a direction generally inward into the second end 22 of the receptacle 18. The third threads 103 may insert into the fourth threads 104 to connect the third threads 103 to the fourth threads 104.

In another embodiment, the third threads 103 may be female threads, and the fourth threads 104 may be male threads. For example, the third threads 103 may extend in a direction generally inward into the second cover 12, and/or the fourth threads 104 may extend in a direction generally outward from the second end 22 of the receptacle 18. The fourth threads 104 may insert into the third threads 103 to connect the fourth threads 104 to the third threads 103.

As shown in FIGS. 6 and 10, the second cover 12 may have a second o-ring 112. The second o-ring 112 may be a loop which may have a disc-shaped cross-section. The second o-ring 112 may be made from any material. In an embodiment, the second o-ring 112 may be an elastomer, such as, for example, silicone. In an embodiment where the second o-ring 112 is connected to the second cover 12, the second o-ring 112 may be located adjacent to the third threads 103. In an embodiment where the second o-ring 112 is connected to the second end 22 of the receptacle 18, the second o-ring 112 may be located adjacent to the fourth threads 104.

The second o-ring 112 may be compressed if the second cover 12 is connected to the second end 22 of the receptacle 18. The second o-ring 112 may create a seal between the second cover 12 and the second end 22 of the receptacle 18. The second o-ring 112 may prevent and/or may hinder odor from exiting the receptacle 18 and/or the second cover 12. The second o-ring 112 may prevent water and/or other liquids from entering the receptacle 18 and/or the second cover 12.

As previously set forth, the teeth 35 may extend from the inner face 71 of the first cover 11 and/or the inner face 73 of the second cover 12. As shown in FIGS. 11-14, the first cover 11 and/or the second cover 12 may be used to grind, to divide and/or to separate the smoking material into smaller sizes. The smoking material may be placed on the inner face 71 of the first cover 11 or the inner face 73 of the second cover 17. Then, the first cover 11 may be connected to the second cover 12 so that the smoking material is located between the inner face 71 of the first cover 11 and the inner face 73 of the second cover 12.

The first threads 101 may connect to the third threads 103 to connect the first cover 11 to the second cover 12. For example, rotation of the first cover 11 in a first direction relative to the second cover 12 may connect the first threads 101 to the third threads 103 to connect the first cover 11 to the second cover 12.

The first threads 101 may be angled relative to the first cover 11 at approximately the same angle that the third threads 103 are angled relative to the second cover 12. In an embodiment, the first threads 101 may be male threads and the third threads 103 may be female threads. For example, the first threads 101 may extend in a direction generally outward from the first cover 11, and/or the third threads 103 may extend in a direction generally inward into the second cover 12. The first threads 101 may insert into the third threads 103 to connect the first threads 101 to the third threads 103.

In another embodiment, the first threads 101 may be female threads, and the third threads 103 may be male threads. For example, the first threads 101 may extend inward into the first cover 11, and/or the third threads 103 may extend in a direction generally outward from the second cover 12. The third threads 103 may insert into the first threads 101 to connect the first threads 101 to the third threads 103.

The smoking material may be placed on the inner face 71 of the first cover 11 and/or the inner face 73 of the second cover 12. Connection of the first cover 11 to the second cover 12 may separate the smoking material into smaller sizes. For example, connection of the first cover 11 to the second cover 12 may decrease the distance between the inner face 71 of the first cover 11 and the teeth 35 of the second cover 12. Connection of the first cover 11 to the second cover 12 may decrease the distance between the inner face 73 of the second cover 12 and the teeth 35 of the first cover 11. As the distance between the inner face 71 of the first cover 11 and the teeth 35 of the second cover 12 decreases, the smoking material located between the inner face 71 of the first cover 11 and the teeth 35 of the second cover 12 may be broken into smaller sizes. As the distance between the inner face 73 of the second cover 12 and the teeth 35 of the first cover 11 decreases, the smoking material located between the inner face 73 of the second cover 12 and the teeth 35 of the first cover 11 may be broken into smaller sizes.

After connecting the first cover 11 to the second cover 12, the user may rotate the first cover 11 and/or the second cover 12 to rotate the teeth 35. For example, the user may rotate the first cover 11 and/or the second cover 12 to connect the first cover 11 to the second cover 12; then, the user may continue to rotate the first cover 11 and/or the second cover 12 to rotate the teeth 35. Rotation of the teeth 35 may separate the smoking material into smaller sizes.

Then, the first threads 101 may disconnect from the third threads 103 to disconnect the first cover 11 from the second cover 12. For example, the first cover 11 may be rotated relative to the second cover 12 in a second direction opposite to the first direction. Rotation of the first cover 11 in the second direction may disconnect the first threads 101 from the third threads 103 to disconnect the first cover 11 from the second cover 12. After disconnecting the first cover 11 from the second cover 12, the smoking material having the smaller sizes may be placed in the first cavity 31 for storage, transportation, and/or use in the pipe 19.

In an embodiment, the first cover 11 and the second cover 12 may be provided without the receptacle 18. For example, the first cover 11 and the second cover 12 may be provided without the receptacle 18 as a "grinder" as known to one having ordinary skill in the art. The present invention does not require the receptacle 18 for the first cover 11 to be used with the second cover 12, and the first cover 11 and the second cover 12 may be provided and/or may be used in the absence of the receptacle 18 in some embodiments.

The embodiments of the receptacle 18 depicted in FIGS. 1-14 may be modified using replacement components. For example, as shown in FIGS. 15-18, the first cover 11 may be replaced with a replacement first cover 211. The replacement first cover 211 may have a surface 250, and/or the teeth 35 may extend from the surface 250. The surface 250 may be located adjacent to the first threads 101, and/or the teeth 35 may extend from the surface 250 in a direction away from the first threads 101. The surface 250 may be adjacent to the first cavity 31 and/or the second threads 102 if the replacement first cover 211 is connected to the first end 21 of the receptacle 21. In an embodiment, the surface 250 may be integral with the replacement first cover 211.

A modular component 214 may connect to the replacement first cover 211 to position the replacement first cover 211 between the receptacle 18 and the modular component 214. For example, the replacement first cover 211 may be positioned between the first cavity 31 and the modular component 214.

The replacement first cover 211 may have fifth threads 205 located in a position opposite to the surface 250 and/or the first threads 101. The fifth threads 205 may be directly connected to the replacement first cover 211. For example, the fifth threads 205 may be integral with the replacement first cover 211. The modular component 214 may have sixth threads 206 which may be directly connected to the modular component 214. For example, the sixth threads 206 may be integral with the modular component 214.

The sixth threads 206 may connect to the fifth threads 205 to connect the modular component 214 to the replacement cover 211. The sixth threads 206 may disconnect from the fifth threads 205 to disconnect the modular component 214 from the replacement cover 211. The modular component 214 may have the teeth 35. The teeth 35 of the modular component 214 may extend in a direction toward the sixth threads 206.

The fifth threads 205 and/or the sixth threads 206 may be helical. The fifth threads 205 may be angled relative to the replacement first cover 211 at approximately the same angle that the sixth threads 206 are angled relative to the modular component 214. In an embodiment, the fifth threads 205 may be male threads, and the sixth threads 206 may be female threads. For example, the fifth threads 205 may extend in a direction generally outward from the replacement first cover 211, and/or the sixth threads 206 may extend in a direction generally inward into the modular component 214. The fifth threads 205 may insert into the sixth threads 206 to connect the fifth threads 205 to the sixth threads 206.

In another embodiment, the fifth threads 205 may be female threads, and the sixth threads 206 may be male threads. For example, the fifth threads 205 may extend in a direction generally inward into the replacement first cover 211, and/or the sixth threads 206 may extend in a direction generally outward from the modular component 214. The sixth threads 206 may insert into the fifth threads 205 to connect the sixth threads 206 to the fifth threads 205.

The surface 250 of the replacement first cover 211 may have holes 240 which may extend through the surface 250. The holes 240 may be located between the teeth 35 extending from the surface 250. The replacement first cover 211 and the modular component 214 may be used to grind, to divide and/or to separate the smoking material into smaller sizes. The first cavity 31 may collect the smoking material having smaller sizes.

More specifically, the smoking material may be placed on the surface 250 of the replacement first cover 211 between the teeth 35 of the replacement first cover 211. Then, the modular component 214 may be connected to the replacement first cover 211. Then, the modular component 214 may be rotated relative to the replacement first cover 11 to rotate the teeth 35. Rotation of the teeth 35 of the replacement first cover 211 and/or the teeth 35 of the modular component 214 may grind, may divide and/or may separate the smoking material into smaller sizes.

The smoking material having smaller sizes may fall through the holes 240 in the surface 250 of the replacement first cover 211. The smoking material having smaller sizes may travel through the holes 240 to enter the first cavity 31. As a result, the smoking material having smaller sizes may be located in the first cavity 31 for storage, transportation, and/or use in the pipe 19.

The replacement first cover 211 and the modular component 214 may be made from any material. In an embodiment, the replacement first cover 211 and/or the modular component 214 may be aluminum. In another embodiment, the replacement first cover 211 and/or the modular component 214 may be plastic. In an embodiment, the replacement first cover 211 and/or the modular component 214 may have an anodized finish. The replacement first cover 211 and the modular component 214 may be made using any manufacturing method known to one having ordinary skill in the art. In an embodiment, the replacement first cover 211 and/or the modular component 214 may be manufactured using an extrusion process.

Figure 19:
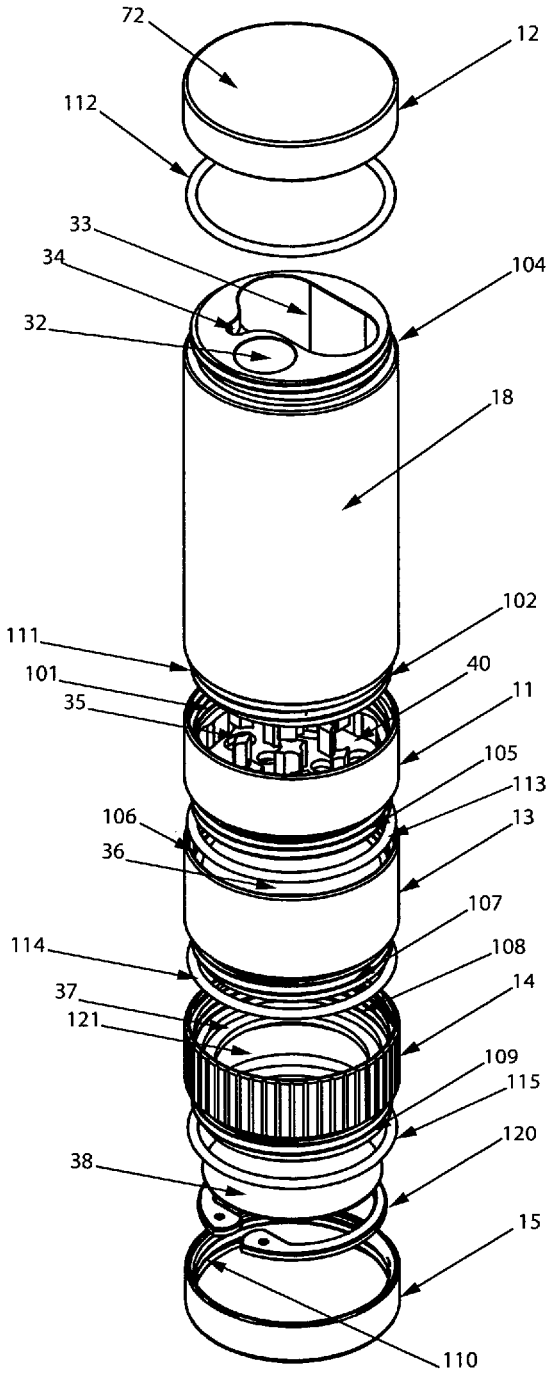
Figure 20:
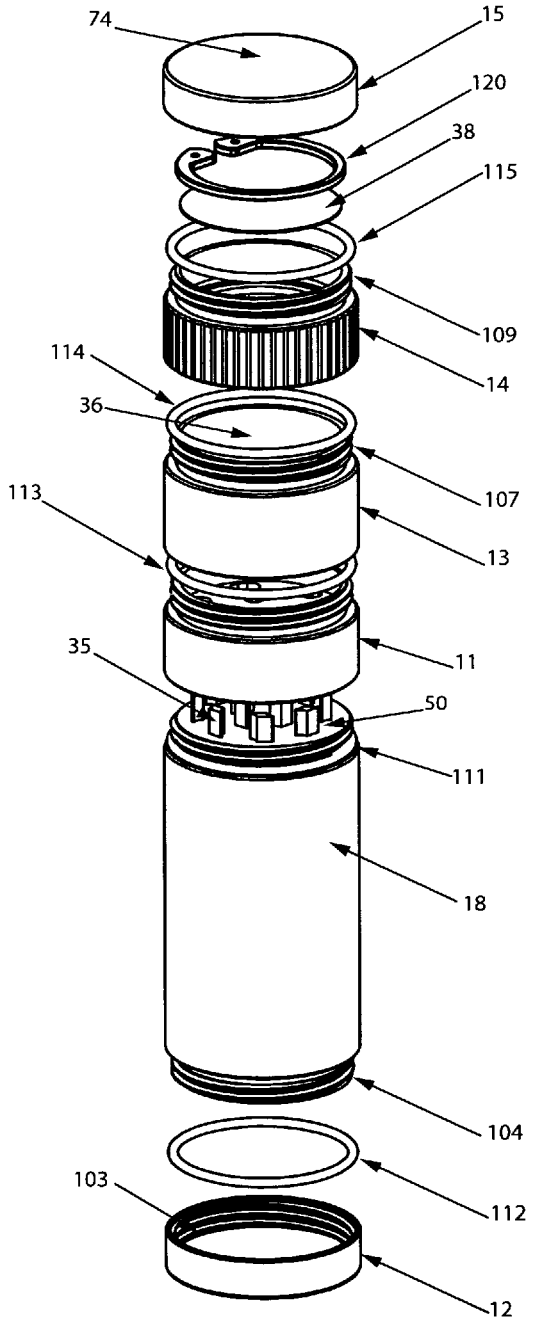

FIGS. 19-29 generally illustrate another embodiment of the receptacle 18. As shown in FIG. 20, the first end 21 of the receptacle 18 may have a surface 50. The surface 50 may be connected to the first end 21 of the receptacle 18. In an embodiment, the surface 50 may be integral with the receptacle 18. The teeth 35 may extend from the surface 50 at the first end 21 of the receptacle 18. In this embodiment, the first cavity 31 may be absent from the first end 21 of the receptacle 18.

As shown in FIG. 19, the first cover 11 may have holes 40 which may extend from the inner face 71 of the first cover 11 to the outer face 72 of the first cover 11. The holes 40 may be located between the teeth 35 extending from the first cover 11. In this embodiment, the teeth 35 may be absent from the second cover 12.

Referring to FIGS. 19 and 20, the first cover 11 may have fifth threads 105 located in a position opposite to the first threads 101. The fifth threads 105 may enable an extension cylinder 13 to connect to the first cover 11. For example, the extension cylinder 13 may have sixth threads 106, and the sixth threads 106 may connect to the fifth threads 105. The sixth threads 106 may disconnect from the fifth threads 105 to disconnect the extension cylinder 13 from the first cover 11. The extension cylinder 13 may connect to the first cover 11 to position the first cover 11 between the receptacle 18 and the extension cylinder 13.

The fifth threads 105 and/or the sixth threads 106 may be directly connected to the first cover 11 and/or the extension cylinder 13, respectively. For example, the fifth threads 105 and/or the sixth threads 106 may be integral with the first cover 11 and/or the extension cylinder 13, respectively.

Rotation of the extension cylinder 13 in a first direction relative to the first cover 11 may disconnect the sixth threads 106 from the fifth threads 105. As a result, the extension cylinder 13 may disconnect from the first cover 11. The extension cylinder 13 may be rotated relative to the first cover 11 in a second direction opposite to the first direction. Rotation of the extension cylinder 13 in the second direction may re-connect the sixth threads 106 to the fifth threads 105. As a result, the extension cylinder 13 may re-connect to the first cover 11.

The fifth threads 105 and/or the sixth threads 106 may be helical. The fifth threads 105 may be angled relative to the first cover 11 at approximately the same angle that the sixth threads 106 are angled relative to the extension cylinder 13. In an embodiment, the fifth threads 105 may be male threads, and the sixth threads 106 may be female threads. For example, the fifth threads 105 may extend in a direction generally outward from the first cover 11, and/or the sixth threads 106 may extend in a direction generally inward into the extension cylinder 13. The fifth threads 105 may insert into the sixth threads 106 to connect the fifth threads 105 to the sixth threads 106.

In another embodiment, the fifth threads 105 may be female threads, and the sixth threads 106 may be male threads. For example, the fifth threads 105 may extend in a direction generally inward into the first cover 11, and/or the sixth threads 106 may extend in a direction generally outward from the extension cylinder 13. The sixth threads 106 may insert into the fifth threads 105 to connect the sixth threads 106 to the fifth threads 105.

The first cover 11 and/or the extension cylinder 13 may have a third o-ring 113. The third o-ring 113 may be a loop which may have a disc-shaped cross-section. The third o-ring 113 may be made from any material. In an embodiment, the third o-ring 113 may be an elastomer, such as, for example, silicone. In an embodiment where the third o-ring 113 is connected to the first cover 11, the third o-ring 113 may be located adjacent to the fifth threads 105. In an embodiment where the third o-ring 113 is connected to the extension cylinder 13, the third o-ring 113 may be located adjacent to the sixth threads 106.

The third o-ring 113 may be compressed if the first cover 11 is connected to the extension cylinder 13. The third o-ring 113 may create a seal between the first cover 11 and the extension cylinder 13. The third o-ring 113 may prevent and/or may hinder odor from exiting the first cover 11 and/or the extension cylinder 13. The third o-ring 113 may prevent water and/or other liquids from entering the first cover 11 and/or the extension cylinder 13.

A sieve cylinder 14 may connect to the extension cylinder 13. For example, the extension cylinder 13 may have seventh threads 107 located in a position opposite to the sixth threads 106. The sieve cylinder 14 may have eighth threads 108. The seventh threads 107 and/or the eighth threads 108 may be directly connected to the extension cylinder 13 and/or the sieve cylinder 14, respectively. For example, the seventh threads 107 and/or the eighth threads 108 may be integral with the extension cylinder 13 and/or the sieve cylinder 14, respectively.

The eighth threads 108 may connect to the seventh threads 107 to connect the sieve cylinder 14 to the extension cylinder 13. The eighth threads 108 may disconnect from the seventh threads 107 to disconnect the sieve cylinder 14 from the extension cylinder 13. The sieve cylinder 14 may connect to the extension cylinder 13 to position the extension cylinder 13 between the first cover 11 and the sieve cylinder 14.

Rotation of the sieve cylinder 14 in a first direction relative to the extension cylinder 13 may disconnect the eighth threads 108 from the seventh threads 107. As a result, the sieve cylinder 14 may disconnect from the extension cylinder 13. Then, the sieve cylinder 14 may be rotated relative to the extension cylinder 13 in a second direction opposite to the first direction. Rotation of the sieve cylinder 14 in the second direction may re-connect the eighth threads 108 to the seventh threads 107. As a result, the sieve cylinder 14 may re-connect to the extension cylinder 13.

The eighth threads 108 may be helical and/or may be angled relative to the sieve cylinder 14 at approximately the same angle that the seventh threads 107 are angled relative to the extension cylinder 13. In an embodiment, the seventh threads 107 may be male threads, and the eighth threads 108 may be female threads. For example, the seventh threads 107 may extend in a direction generally outward from the extension cylinder 13, and/or the eighth threads 108 may extend in a direction generally inward into the sieve cylinder 14. The seventh threads 107 may insert into the eighth threads 108 to connect the seventh threads 107 to the eighth threads 108.

In another embodiment, the seventh threads 107 may be female threads, and the eighth threads 108 may be male threads. For example, the seventh threads 107 may extend in a direction generally inward into the extension cylinder 13, and/or the eighth threads 108 may extend in a direction generally outward from the sieve cylinder 14. The eighth threads 108 may insert into the seventh threads 107 to connect the eighth threads 108 to the seventh threads 107.

The sieve cylinder 14 and/or the extension cylinder 13 may have a fourth o-ring 114. The fourth o-ring 114 may be a loop which may have a disc-shaped cross-section. The fourth o-ring 114 may be made from any material. In an embodiment, the fourth o-ring 114 may be an elastomer, such as, for example, silicone. The fourth o-ring 114 may be connected to the sieve cylinder 14 or the extension cylinder 13. The fourth o-ring 114 may be compressed if the sieve cylinder 14 connects to the extension cylinder 13, and/or the fourth o-ring 114 may create a seal between the extension cylinder 13 and the sieve cylinder 14. The fourth o-ring 114 may prevent and/or may hinder odor from exiting the extension cylinder 13 and/or the sieve cylinder 14, and/or the fourth o-ring 114 may prevent water and/or other liquids from entering the extension cylinder 13 and/or the sieve cylinder 14.

A sieve cap 15 may connect to the sieve cylinder 14. For example, the sieve cylinder 14 may have ninth threads 109 located in a position opposite to the eighth threads 108, and/or the sieve cap 15 may have tenth threads 110. The sieve cap 15 may have an outer face 74 which may be located in a position opposite to the tenth threads 110.

The tenth threads 110 may connect to the ninth threads 109 to connect the sieve cap 15 to the sieve cylinder 14. The tenth threads 110 may disconnect from the ninth threads 109 to disconnect the sieve cap 15 from the sieve cylinder 14. The sieve cap 15 may connect to the sieve cylinder 14 to position the sieve cylinder 14 between the extension cylinder 13 and the sieve cap 15.

The ninth threads 109 and/or the tenth threads 110 may be directly connected to the sieve cylinder 14 and/or the sieve cap 15, respectively. For example, the ninth threads 109 and/or the tenth threads 110 may be integral with the sieve cylinder 14 and/or the sieve cap 15, respectively.

Rotation of the sieve cap 15 in a first direction relative to the sieve cylinder 14 may disconnect the tenth threads 110 from the ninth threads 109. As a result, the sieve cap 15 may disconnect from the sieve cylinder 14. The sieve cap 15 may be rotated relative to the sieve cylinder 14 in a second direction opposite to the first direction. Rotation of the sieve cap 15 in the second direction may re-connect the tenth threads 110 to the ninth threads 109. As a result, the sieve cap 15 may re-connect to the sieve cylinder 14.

The ninth threads 109 and/or the tenth threads 110 may be helical. The ninth threads 109 may be angled relative to the sieve cylinder 14 at approximately the same angle that the tenth threads 110 are angled relative to the sieve cap 15. In an embodiment, the ninth threads 109 may be male threads, and the tenth threads 110 may be female threads. For example, the ninth threads 109 may extend in a direction generally outward from the sieve cylinder 14, and/or the tenth threads 110 may extend in a direction generally inward into the sieve cap 15. The ninth threads 109 may insert into the tenth threads 110 to connect the ninth threads 109 to the tenth threads 110.

In another embodiment, the ninth threads 109 may be female threads, and the tenth threads 110 may be male threads. For example, the ninth threads 109 may extend in a direction generally inward into the sieve cylinder 14, and/or the tenth threads 110 may extend in a direction generally outward from the sieve cap 15. The tenth threads 110 may insert into the ninth threads 109 to connect the tenth threads 110 to the ninth threads 109.

The sieve cylinder 14 and/or the sieve cap 15 may have a fifth o-ring 115. The fifth o-ring 115 may be a loop which may have a disc-shaped cross-section. The fifth o-ring 115 may be made from any material. In an embodiment, the fifth o-ring 115 may be an elastomer, such as, for example, silicone. The fifth o-ring 115 may be connected to the sieve cylinder 14 or the sieve cap 15. If the fifth o-ring 115 is connected to the sieve cylinder 14, the fifth o-ring 115 may be connected to the sieve cylinder 14 adjacent to the ninth threads 110. If the fifth o-ring 115 is connected to the sieve cap 15, the fifth o-ring 115 may be connected to the sieve cap 15 adjacent to the tenth threads 110.

The fifth o-ring 115 may be compressed if the sieve cap 15 connects to the sieve cylinder 14, and/or the fifth o-ring 115 may create a seal between the sieve cap 15 and the sieve cylinder 14. The fifth o-ring 115 may prevent and/or may hinder odor from exiting the sieve cap 15 and/or the sieve cylinder 14, and/or the fifth o-ring 115 may prevent water and/or other liquids from entering the sieve cap 15 and/or the sieve cylinder 14.

Figure 21:
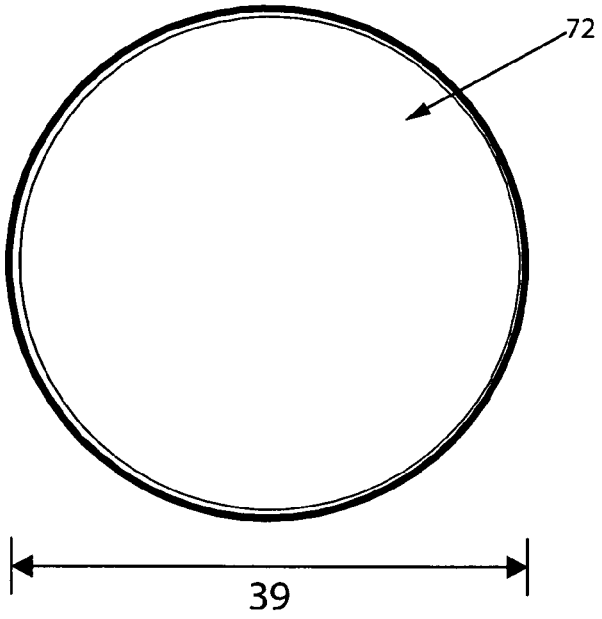
FIG. 21 illustrates a top plan view of a receptacle with the second cover connected to the receptacle in an embodiment of the present invention.
Figure 22:
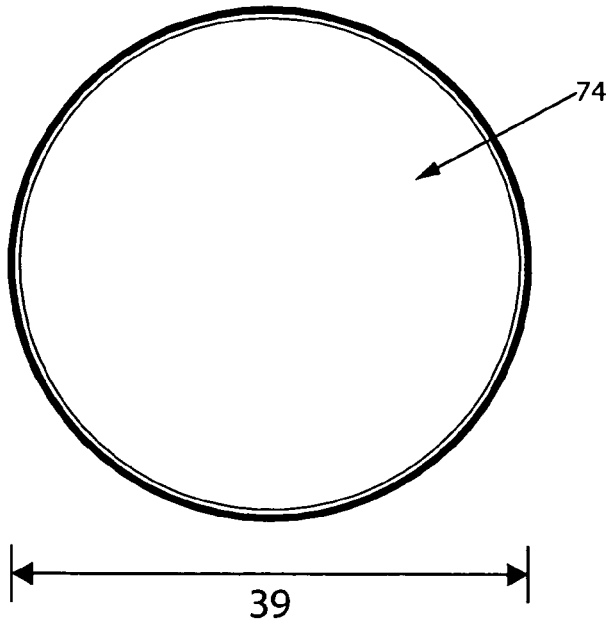
FIG. 22 illustrates a bottom plan view of a receptacle with the sieve cap connected to the receptacle from an opposite view relative to FIG. 21 in an embodiment of the present invention.
Figure 23:
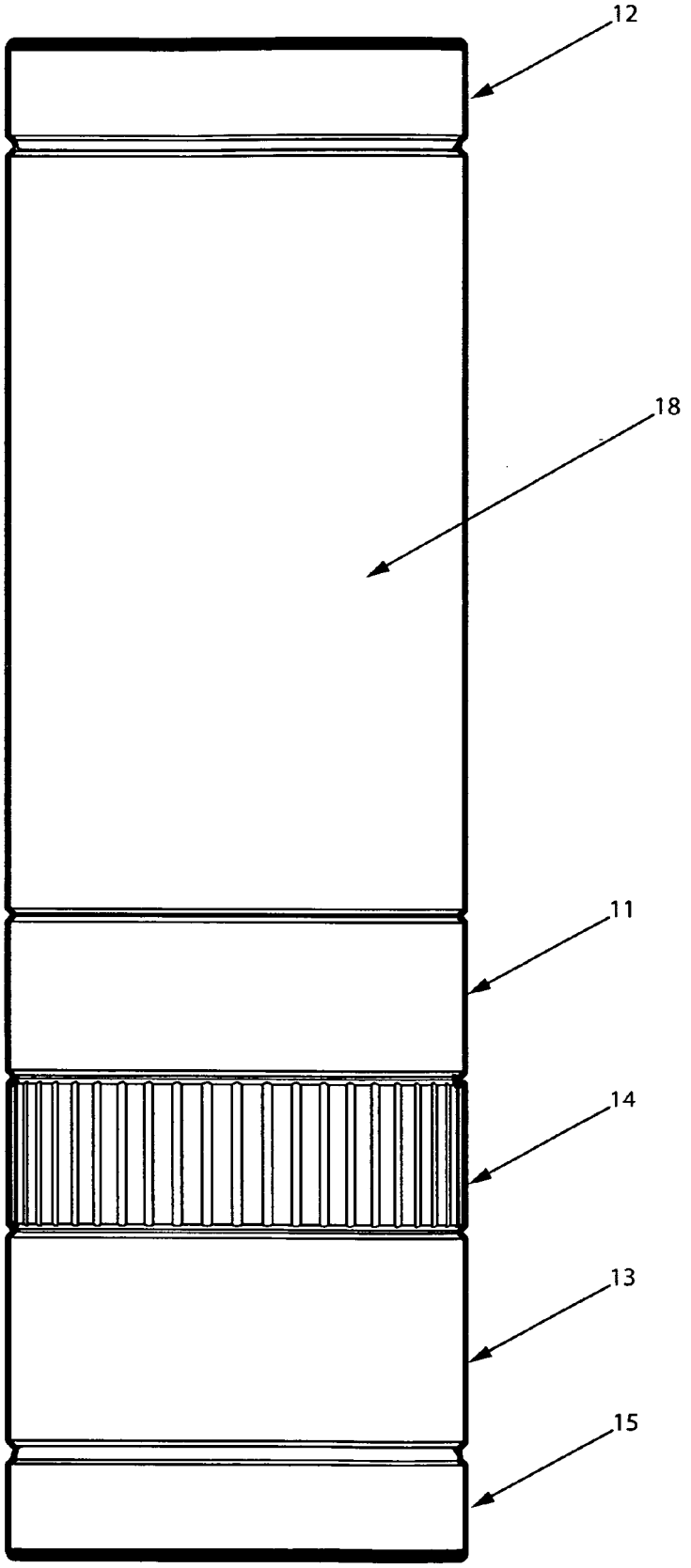
Figure 24:
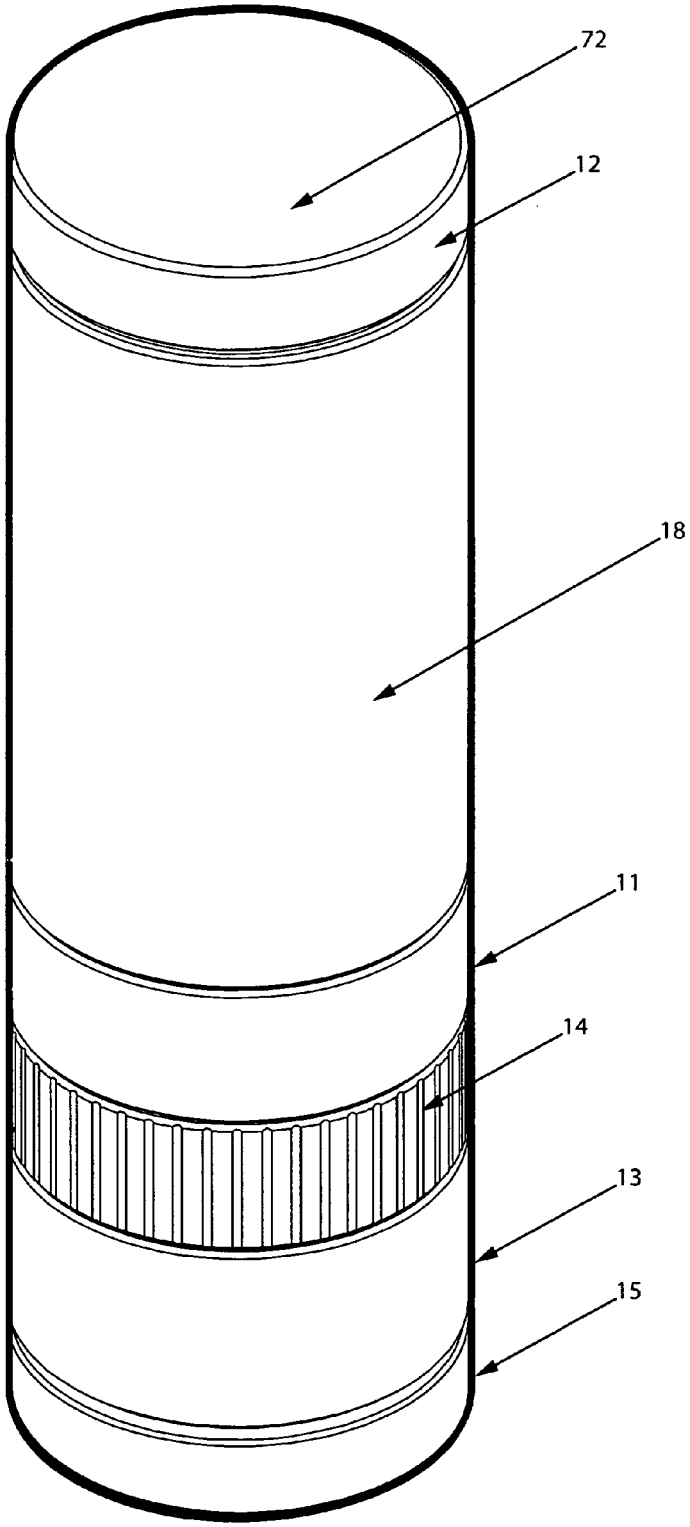
Figure 25:
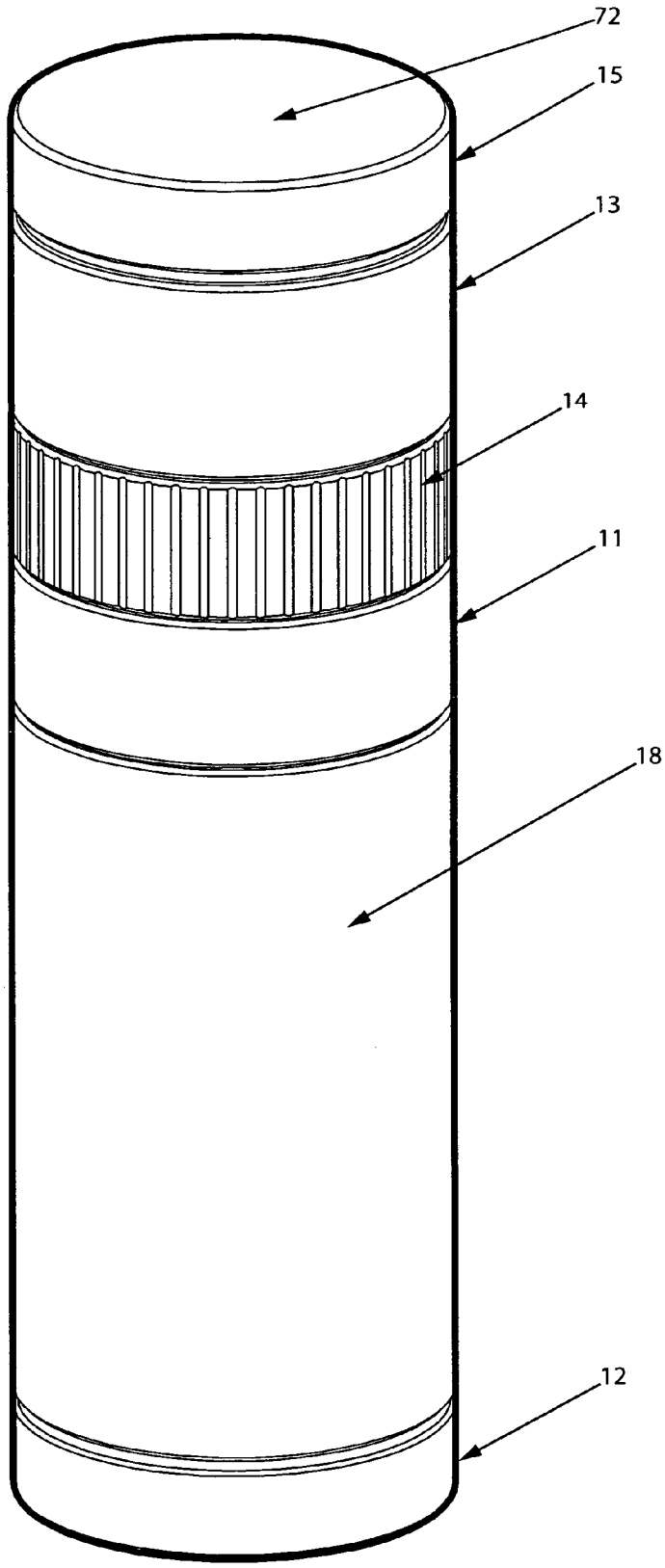
Figure 26:
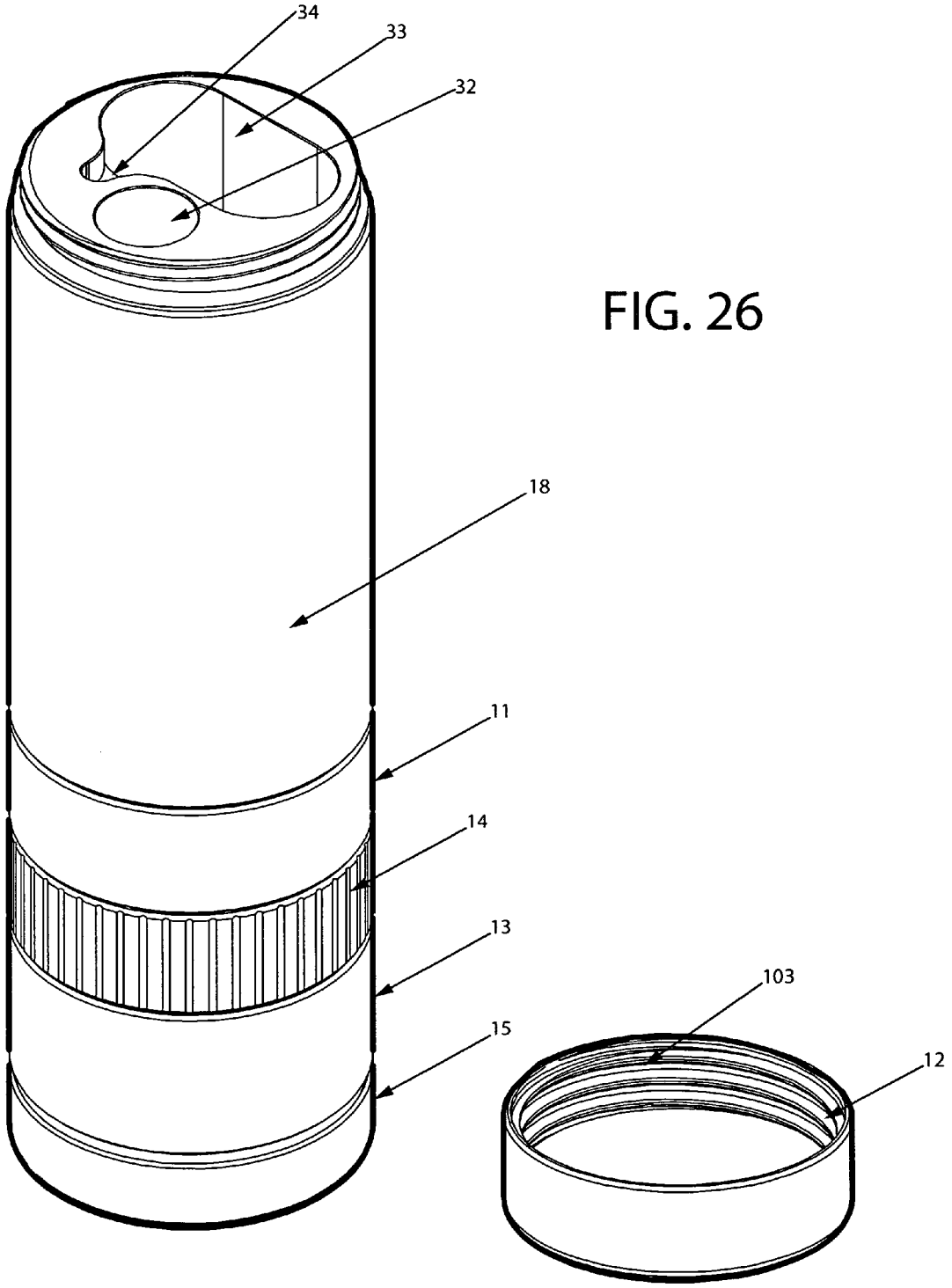
Figure 27:
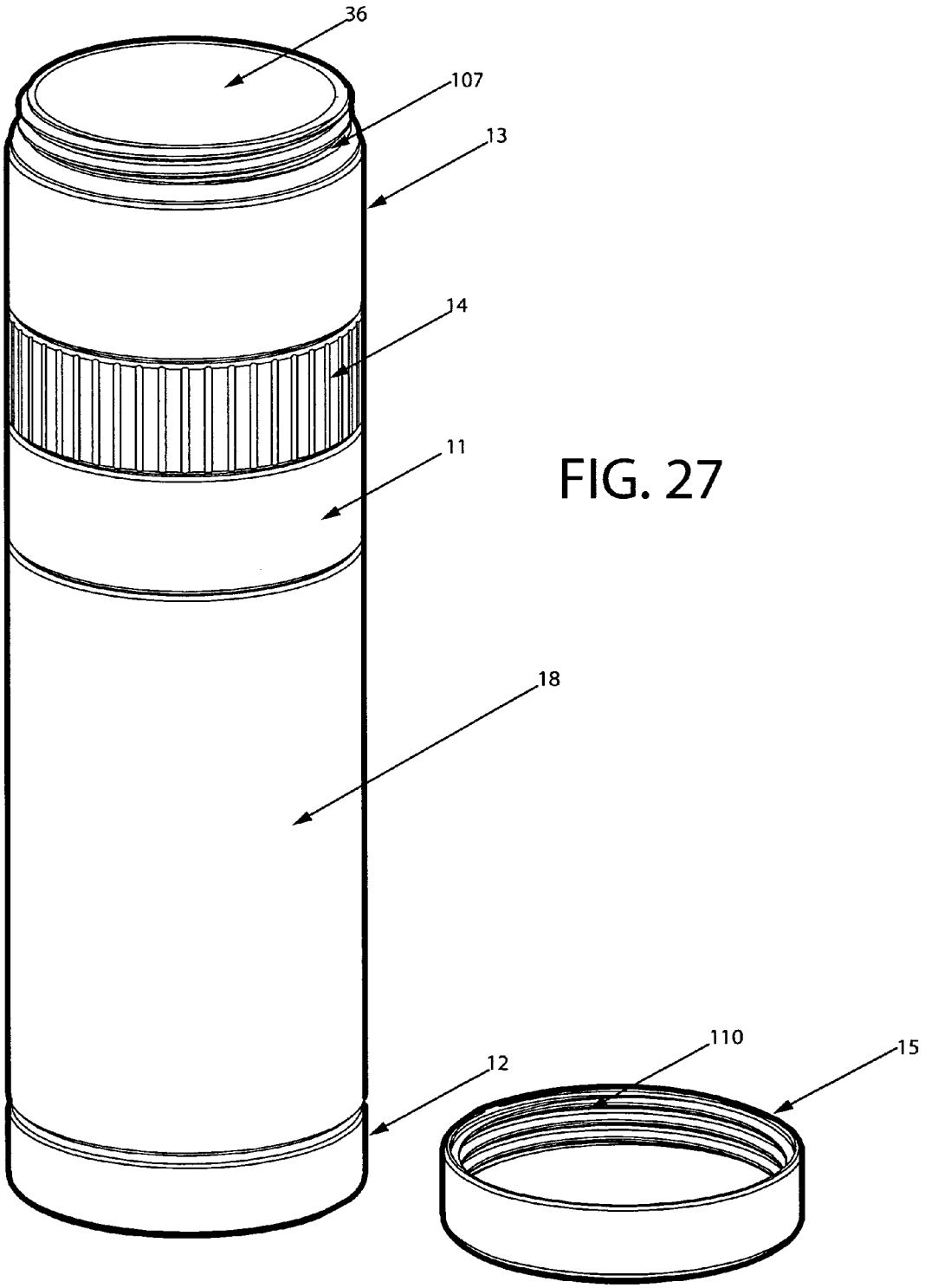
Figure 28:
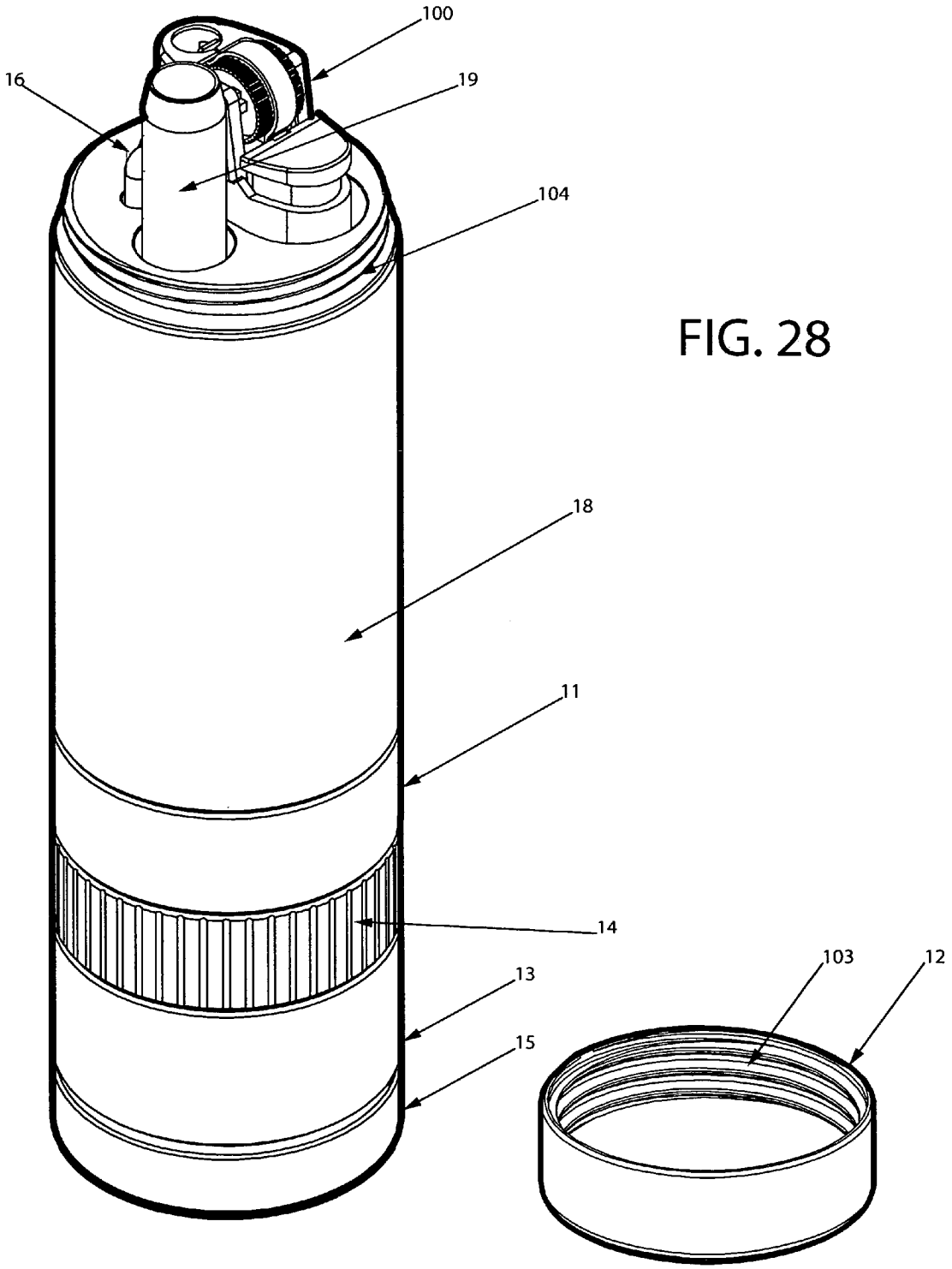
Figure 29:
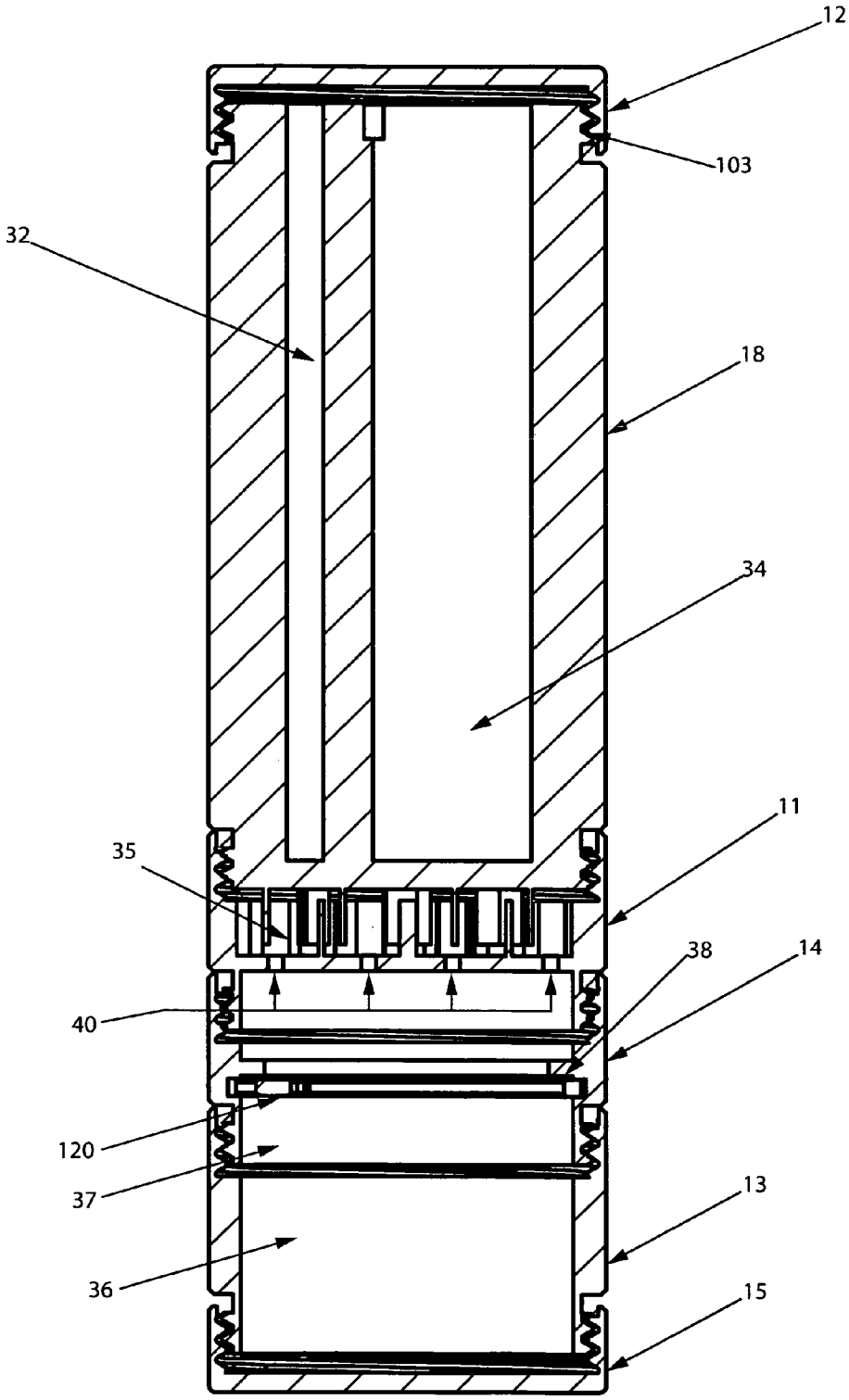

In the embodiment of the receptacle depicted in FIGS. 19-29, the diameter of the receptacle 18, the first cover 11, the second cover 12, the extension cylinder 13, the sieve cylinder 14 and/or the sieve cap 15 may be uniform. More specifically, as shown in FIGS. 21 and 22, the receptacle 18, the first cover 11, the second cover 12, the extension cylinder 13, the sieve cylinder 14 and/or the sieve cap 15 may have the same diameter 39. In an embodiment, the diameter 39 of the receptacle 18, the first cover 11, the second cover 12, the extension cylinder 13, the sieve cylinder 14 and/or the sieve cap 15 may be approximately 1.25 inches. However, the present invention is not limited to a specific diameter of the receptacle 18, the first cover 11, the second cover 12, the extension cylinder 13, the sieve cylinder 14 or the sieve cap 15.

Referring again to FIGS. 19 and 20, the extension cylinder 13 may have an extension cavity 36. The extension cylinder 13 may be hollow such that the extension cavity 36 extends from the end of the extension cylinder 13 having the sixth threads 106 to the opposite end of the extension cylinder 13 having the seventh threads 107.

The sieve cylinder 14 may have a sieve cavity 37. The sieve cylinder 14 may be hollow such that the sieve cavity 37 extends from the end of the sieve cylinder 14 having the eighth threads 108 to the opposite end of the sieve cylinder 14 having the ninth threads 109.

A screen 38 may be located in the sieve cylinder 14 and/or the sieve cavity 37. The extension cavity 36 and/or the sieve cavity 37 may form a passage extending directly from the holes 40 of the first cover 11 to the sieve cap 15, and the screen 38 may be located in the passage. The screen 38 may be made from any material. In an embodiment, the screen 38 may be stainless steel. The screen 38 may be located in a position opposite to the eighth threads 108. The screen 38 may be a mesh screen. For example, the screen 38 may have openings having a diameter between approximately one hundred microns and approximately two hundred microns. The present invention is not limited to a specific material of the screen 38 or a specific size of the openings of the screen 38.

A snap ring 120 may position the screen 38 within the sieve cavity 37. For example, the sieve cylinder 14 may have a lip 121 which extends into the sieve cavity 37. The lip 121 may be connected to the sieve cylinder 14. In an embodiment, the lip 121 may be integral with the sieve cylinder 14. Inserting the snap ring 120 into the sieve cavity 37 may position the screen 38 between the snap ring 120 and the lip 121. As a result, the snap ring 120 may maintain the position of the screen 38 in the sieve cavity 37.

The snap ring 120 may be removed from the sieve cavity 37 to replace the screen 38. For example, the snap ring 120 may be removed from the sieve cavity 37, and then the screen 38 may be removed from the sieve cavity 37. A new screen 38 may be positioned in the sieve cavity 37, and then the snap ring 120 may be inserted into the sieve cavity 37 to position the screen 38 between the snap ring 120 and the lip 121.

The receptacle 18 and/or the first cover 11 may be used to grind, to divide and/or to separate the smoking material into smaller sizes. The sieve cylinder 14, the screen 38 and/or the sieve cap 15 may collect the smoking material having smaller sizes.

More specifically, the smoking material may be placed on the inner face 71 of the first cover 11 or the surface 50 of the first end 21 of the receptacle 18. Then, the first cover 11 may be connected to the first end 21 of the receptacle 18 so that the smoking material is located between the inner face 71 of the first cover 11 and the surface 50 of the first end 21 of the receptacle 18. As previously set forth, the first threads 101 may connect to the second threads 102 to connect the first cover 11 to the first end 21 of the receptacle 18.

Connection of the first cover 11 to the first end 21 of the receptacle 18 may separate the smoking material into smaller sizes. For example, connection of the first cover 11 to the first end 21 of the receptacle 18 may decrease the distance between the inner face 71 of the first cover 11 and the teeth 35 of the first end 21 of the receptacle 18. Connection of the first cover 11 to the first end 21 of the receptacle 18 may decrease the distance between the surface 50 at the first end 21 of the receptacle 18 and the teeth 35 of the first cover 11. As the distance between the inner face 71 of the first cover 11 and the teeth 35 of the first end 21 of the receptacle 18 decreases, the smoking material located between the inner face 71 of the first cover 11 and the teeth 35 of the first end 21 of the receptacle 18 may be broken into smaller sizes. As the distance between the surface 50 of the first end 21 of the receptacle 18 and the teeth 35 of the first cover 11 decreases, the smoking material located between the surface 50 of the first end 21 of the receptacle 18 and the teeth 35 of the first cover 11 may be broken into smaller sizes.

After connecting the first cover 11 to the first end 21 of the receptacle 18, the user may rotate the first cover 11 relative to the first end 21 of the receptacle 18 to rotate the teeth 35. For example, the user may rotate the first cover 11 to connect the first cover 11 relative to the first end 21 of the receptacle 18; then, the user may continue to rotate the first cover 11 to rotate the teeth 35. The user may rotate the first cover 11 relative to the first end 21 of the receptacle 18 in a first direction; then, the user may rotate the first cover 11 relative to the first end 21 of the receptacle 18 in a second direction opposite to the first direction; then, the user may repeat these steps as many times as desired. Rotation of the teeth 35 one or more times may separate the smoking material into smaller sizes.

The smoking material having smaller sizes may fall through the holes 40. As previously set forth, the holes 40 may extend from the inner face 71 of the first cover 11 to the outer face 72 of the first cover 11. The smoking material having smaller sizes may travel through the holes 40 to enter the extension cavity 36 and/or the sieve cavity 37. The smoking material having smaller sizes may be collected by the screen 38. As a result, the smoking material having smaller sizes may be located in the sieve cylinder 14 for storage, transportation, and/or use in the pipe 19.

For example, the sieve cylinder 14 may disconnect from the extension cylinder 13. Disconnecting the sieve cylinder 14 from the extension cylinder 13 may provide access to the sieve cavity 37. Then, the user may insert the pipe 19 into the sieve cavity 37 to push the smoking material located in the sieve cavity 37 and/or on the screen 38 into the pipe 19. Then, the user may re-connect the sieve cylinder 14 to the extension cylinder 13. Re-connecting the sieve cylinder 14 to the extension cylinder 13 may limit and/or may prevent access to the sieve cavity 37.

As another example, the extension cylinder 13 may be disconnected from the first cover 11 while the sieve cylinder 14 is connected to the extension cylinder 13. Disconnecting the extension cylinder 13 from the first cover 11 while the sieve cylinder 14 is connected to the extension cylinder 13 may provide access to the sieve cavity 37 through the extension cavity 36. Then, the user may insert the pipe 19 through the extension cavity 36 into the sieve cavity 37 to push the smoking material located in the sieve cavity 37 and/or on the screen 38 into the pipe 19. Then, the user may re-connect the extension cylinder 13 to the first cover 11. Re-connecting the extension cylinder 13 to the first cover 11 while the sieve cylinder 14 is connected to the extension cylinder 13 may limit and/or may prevent access to the sieve cavity 37.

Some of the smoking material having smaller sizes may travel through the screen 38 into the screen cap 15. The smoking material having smaller sizes which travels through the screen 38 is known as "kief." The kief may be located in the sieve cap 15 for storage, transportation, and/or use in the pipe 19. For example, the sieve cap 15 may be disconnected from the sieve cylinder 14 to provide access to the kief. Then, the user may insert the pipe 19 into the sieve cap 15 to push the kief located in the sieve cap 15 into the pipe 19. The sieve cap 15 may then be re-connected to the sieve cylinder 14.

The extension cylinder 13, the sieve cylinder 14 and the sieve cap 15 may be made from any material. In an embodiment, the extension cylinder 13, the sieve cylinder 14 and/or the sieve cap 15 may be aluminum. In another embodiment, the extension cylinder 13, the sieve cylinder 14 and/or the sieve cap 15 may be plastic. In an embodiment, the extension cylinder 13, the sieve cylinder 14 and/or the sieve cap 15 may have an anodized finish. The extension cylinder 13, the sieve cylinder 14 and/or the sieve cap 15 may be made using any manufacturing method known to one having ordinary skill in the art. In an embodiment, the extension cylinder 13, the sieve cylinder 14 and/or the sieve cap 15 may be manufactured using an extrusion process.

The location of the extension cylinder 13 may be changed. As shown in FIGS. 23-29, the sieve cylinder 14 may connect directly to the first cover 11. The extension cylinder 13 may connect directly to the sieve cylinder 14 and/or the sieve cap may connect directly to the extension cylinder 13 to position the extension cylinder 13 between the sieve cylinder 14 and the sieve cap 15.

For example, the eighth threads 108 may connect to the fifth threads 105 to connect the sieve cylinder 14 to the first cover 11. The sixth threads 106 may connect to the ninth threads 109 to connect the extension cylinder 13 to the sieve cylinder 14. The tenth threads 110 may connect to the seventh threads 107 to connect the sieve cap 15 to the extension cylinder 13. The sixth threads 106 may be angled relative to the extension cylinder 13 at approximately the same angle that the ninth threads 109 are angled relative to the sieve cylinder 14, and/or the tenth threads 110 may be angled relative to the sieve cap 15 at approximately same angle that the seventh threads 107 are angled relative to extension cylinder 13.

Despite the different position of the extension cylinder 13, the receptacle 18 and/or the first cover 11 may be used to grind, to divide and/or to separate the smoking material into smaller sizes. The sieve cylinder 14, the screen 38 and/or the sieve cap 15 may collect the smoking material having smaller sizes.

More specifically, the smoking material may be placed on the inner face 71 of the first cover 11 or the surface 50 of the first end 21 of the receptacle 18. Then, the first cover 11 may be connected to the first end 21 of the receptacle 18 so that the smoking material is located between the inner face 71 of the first cover 11 and the surface 50 of the first end 21 of the receptacle 18. The teeth 35 of the first cover 11 and the teeth 35 at the first end 21 of the receptacle 18 may grind, may divide and/or may separate the smoking material into smaller sizes as previously set forth for the embodiment where the extension cylinder 13 is present.

The smoking material having smaller sizes may fall through the holes 40. As previously set forth, the holes 40 may extend from the inner face 71 of the first cover 11 to the outer face 72 of the first cover 11. The smoking material having smaller sizes may travel through the holes 40 to enter the sieve cavity 37. The smoking material having smaller sizes may be collected by the screen 38. As a result, the smoking material having smaller sizes may be located in the sieve cylinder 14 for storage, transportation, and/or use in the pipe 19.

For example, the sieve cylinder 14 may disconnect from the first cover 11. Disconnecting the sieve cylinder 14 from the first cover 11 may provide access to the sieve cavity 37. Then, the user may insert the pipe 19 into the sieve cavity 37 to push the smoking material located in the sieve cavity 37 and/or on the screen 38 into the pipe 19. Then, the user may re-connect the sieve cylinder 14 to the first cover 11. Re-connecting the sieve cylinder 14 to the first cover 11 may limit and/or may prevent access to the sieve cavity 37.

The kief may travel through the screen 38 into the extension cylinder 13. The kief may travel through the extension cylinder 13 via the extension cavity 36. Then, the kief may enter the screen cap 15. The kief may be located in the sieve cap 15 for storage, transportation, and/or use in the pipe 19.

For example, the sieve cap 15 may be disconnected from the extension cylinder 13 to provide access to the kief. Then, the user may insert the pipe 19 into the sieve cap 15 to push the kief located in the sieve cap 15 into the pipe 19. The sieve cap 15 may then be re-connected to the sieve cylinder 14.

Alternatively, the extension cylinder 13 may be disconnected from the sieve cylinder 14 with the sieve cap 15 attached to the extension cylinder 13 to provide access to the kief. Then, the user may insert the pipe 19 through the extension cylinder 13 into the sieve cap 15 to push the kief located in the sieve cap 15 into the pipe 19. The extension cylinder 13 may then be re-connected to the sieve cylinder 14 with the sieve cap 15 attached to the extension cylinder 13.

The receptacle 18 may be provided without and/or may be used without the extension cylinder 13. For example, the sieve cylinder 14 may connect directly to the first cover 11. For example, connecting the eighth threads 108 to the fifth threads 105 may connect the sieve cylinder 14 to the first cover 11. The fifth threads 105 may be angled relative to the first cover 11 at approximately the same angle that the eighth threads 108 are angled relative to the sieve cylinder 14.

Despite the absence of the extension cylinder 13, the receptacle 18 and/or the first cover 11 may be used to grind, to divide and/or to separate the smoking material into smaller sizes. The sieve cylinder 14, the screen 38 and/or the sieve cap 15 may collect the smoking material having smaller sizes.

More specifically, the smoking material may be placed on the inner face 71 of the first cover 11 or the surface 50 of the first end 21 of the receptacle 18. Then, the first cover 11 may be connected to the first end 21 of the receptacle 18 so that the smoking material is located between the inner face 71 of the first cover 11 and the surface 50 of the first end 21 of the receptacle 18. The teeth 35 of the first cover 11 and the teeth 35 at the first end 21 of the receptacle 18 may grind, may divide and/or may separate the smoking material into smaller sizes as previously set forth for the embodiment where the extension cylinder 13 is present.

The smoking material having smaller sizes may fall through the holes 40. As previously set forth, the holes 40 may extend from the inner face 71 of the first cover 11 to the outer face 72 of the first cover 11. The smoking material having smaller sizes may travel through the holes 40 to enter the sieve cavity 37. The smoking material having smaller sizes may be collected by the screen 38. As a result, the smoking material having smaller sizes may be located in the sieve cylinder 14 for storage, transportation, and/or use in the pipe 19.

For example, the sieve cylinder 14 may disconnect from the first cover 11. Disconnecting the sieve cylinder 14 from the first cover 11 may provide access to the sieve cavity 37. Then, the user may insert the pipe 19 into the sieve cavity 37 to push the smoking material located in the sieve cavity 37 and/or on the screen 38 into the pipe 19. Then, the user may re-connect the sieve cylinder 14 to the first cover 11. Reconnecting the sieve cylinder 14 to the first cover 11 may limit and/or may prevent access to the sieve cavity 37.

The kief may travel through the screen 38 into the screen cap 15. The kief may be located in the sieve cap 15 for storage, transportation, and/or use in the pipe 19. For example, the sieve cap 15 may be disconnected from the sieve cylinder 14 to provide access to the kief. Then, the user may insert the pipe 19 into the sieve cap 15 to push the kief located in the sieve cap 15 into the pipe 19. The sieve cap 15 may then be re-connected to the sieve cylinder 14. As another example, the extension cylinder.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by this specification.

We claim:

1. A system for storing smoking material, a pipe and a lighter wherein the pipe has a size and a shape and further wherein the lighter emits a flame and has a size and a shape, the system comprising:

a receptacle having a first end and a second end wherein the second end is located in a position opposite to the first end and further wherein the storage receptacle has a cylindrical shape;

a pipe cavity in the second end of the receptacle wherein the pipe cavity extends from the second end into the receptacle and further wherein the second cavity has a size and a shape which are substantially the same as the size and the shape of the pipe;

a lighter cavity in the second end of the receptacle wherein the lighter cavity extends from the second end into the receptacle and further wherein the second cavity has a size and a shape which are substantially the same as the size and the shape of the lighter;

a first cover which connects to the first end of the receptacle wherein the first cover reversibly connects to and disconnects from the first end and further wherein the first cover has a circular shape;

teeth which extend from the first cover;

holes in the first cover which are located between the teeth of the first cover;

a sieve cylinder which connects to the first cover wherein the sieve cylinder has a sieve cavity which extends into the sieve cylinder and further wherein the sieve cylinder has a screen located in the sieve cavity; and a second cover which connects to the second end of the receptacle wherein the second cover reversibly connects to and disconnects from the second end and further wherein the second cover has a circular shape.

2. The system of claim 1 further comprising:

a cleaning pick cavity which extends from the second end of the receptacle into the receptacle.

3. The system of claim 1 further comprising:

an extension cylinder which connects the sieve cylinder to the first cover.

4. The system of claim 1 further comprising:

a sieve cap which reversibly connects to and disconnects from the sieve cylinder.

5. The system of claim 1 further comprising:

threads integral with the first cover and the sieve cylinder wherein the threads enable the sieve cylinder to reversibly connect to and disconnect from the first cover.

6. The system of claim 1 further comprising:

a ring which maintains a position of the screen in the sieve cylinder wherein the ring disconnects from the sieve cylinder to enable the screen to be removed from the sieve cylinder.

7. The system of claim 1 further comprising:

threads integral with the first cover and the first end of the receptacle wherein the threads enable the first cover to reversibly connect to and separate from the first end.

8. The system of claim 1 wherein the teeth are integral with the first cover.

9. A storage receptacle for smoking material, the storage receptacle comprising:

a receptacle body having a first end and a second end wherein the second end is located in a position opposite to the first end and further wherein the receptacle body has a cylindrical shape;

a first cavity in the first end which holds the smoking material wherein the first cavity extends from the first end into the receptacle body;

a second cavity in the second end wherein the second cavity has a cylindrical shape and further wherein the second cavity extends from the second end into the receptacle body;

a third cavity in the second end wherein the third cavity extends from the second end into the receptacle body;

a first cover that covers the first cavity wherein the first cover reversibly connects to and disconnects from the first end and further wherein the first cover has a circular shape;

a modular component which reversibly connects to and disconnects from the first cover;

teeth which extend from the first cover and the modular component;

holes in the first cover which are located between the teeth extending from the first cover; and a second cover that covers the second cavity and the third cavity wherein the second cover reversibly connects and disconnects from the second end and further wherein the second cover has a circular shape.

10. The storage receptacle of claim 9 further comprising:

threads integral with the first cover and the first end of the receptacle body wherein the threads enable the first cover to reversibly connect to and disconnect from the first end of the receptacle body.

11. The storage receptacle of claim 9 further comprising:

threads integral with the first cover and the modular component wherein the threads enable the modular component to reversibly connect to and disconnect from the first cover.

12. The storage receptacle of claim 9 further comprising:

threads integral with the second cover and the second end of the receptacle body wherein the threads enable the second cover to reversibly connect to and disconnect from the second end of the receptacle body.

13. The storage receptacle of claim 9 further comprising:

a fourth cavity in the second end wherein the fourth cavity has a cylindrical shape and further wherein the fourth cavity extends from the second end into the receptacle body.

* * * * *